US009142365B2

(12) United States Patent
Moroz et al.

(10) Patent No.: US 9,142,365 B2
(45) Date of Patent: Sep. 22, 2015

(54) SOLENOID-DRIVEN AUTOMATIC TRANSFER SWITCH

(71) Applicants: Myron Moroz, Burlington, CT (US); Howard H. Plude, Jr., Avon, CT (US)

(72) Inventors: Myron Moroz, Burlington, CT (US); Howard H. Plude, Jr., Avon, CT (US)

(73) Assignee: Ward Leonard Investment Holdings, LLC, Thomaston, CT (US)

( * ) Notice: Subject to any disclaimer, the term of this patent is extended or adjusted under 35 U.S.C. 154(b) by 237 days.

(21) Appl. No.: 13/768,401

(22) Filed: Feb. 15, 2013

(65) Prior Publication Data

US 2014/0232491 A1 Aug. 21, 2014

(51) Int. Cl.

| | |
|---|---|
| ***H01H 9/00*** | (2006.01) |
| ***H01H 3/30*** | (2006.01) |
| ***H01H 21/42*** | (2006.01) |

(52) U.S. Cl.

CPC ..... *H01H 9/0072* (2013.01); *H01H 3/30* (2013.01); *H01H 21/42* (2013.01)

(58) Field of Classification Search

CPC ..... H01H 9/0072; H01H 3/28; H01H 9/26; H01H 50/647; H01H 2300/018; H02J 9/06

USPC ..... 335/73, 128, 190

See application file for complete search history.

(56) References Cited

U.S. PATENT DOCUMENTS

| | | | | |
|---|---|---|---|---|
| 1,633,812 | A * | 6/1927 | Goff | 335/122 |
| 1,633,833 | A * | 6/1927 | Townsend | 335/128 |
| 1,868,242 | A * | 7/1932 | Mann | 200/15 |
| 1,869,330 | A * | 7/1932 | Anderson | 307/64 |
| 1,904,141 | A * | 4/1933 | Hurlburt | 335/190 |
| 2,452,065 | A * | 10/1948 | Moran et al. | 335/120 |
| 2,944,129 | A | 7/1960 | Cole et al. | |
| 3,517,356 | A | 6/1970 | Hanafusa | |
| 3,697,709 | A | 10/1972 | Witkor | |
| 3,936,782 | A | 2/1976 | Moakler et al. | |
| 4,021,678 | A | 5/1977 | Moakler et al. | |
| 4,157,461 | A | 6/1979 | Wiktor | |
| 4,590,387 | A | 5/1986 | Yoshida et al. | |
| 4,999,598 | A * | 3/1991 | Jannesari et al. | 335/122 |
| 5,070,252 | A | 12/1991 | Castenschiold et al. | |
| 5,638,948 | A | 6/1997 | Sharaf et al. | |
| 6,172,432 | B1 | 1/2001 | Schnackenberg et al. | |
| 6,222,143 | B1 | 4/2001 | Lawson et al. | |
| 6,538,223 | B1 | 3/2003 | Yoshida et al. | |
| 6,693,248 | B1 | 2/2004 | Schultz | |
| 6,765,157 | B2 | 7/2004 | Rademacher et al. | |
| 6,815,624 | B2 | 11/2004 | Schultz | |
| 6,849,811 | B1 | 2/2005 | Heflin et al. | |
| 6,861,930 | B2 | 3/2005 | Simms et al. | |

(Continued)

*Primary Examiner* — Mohamad Musleh

(74) *Attorney, Agent, or Firm* — McCormick Paulding & Huber LLP

(57) ABSTRACT

A solenoid-driven automatic bus transfer switch may automatically transfer one or more electrical loads from a first power source to a second power source, or vice versa, in the event of a power failure or other casualty that affects either power source. The transfer switch may be operated in response to the energization of a solenoid coil, which causes a main shaft having a transfer element to rotate from being in contact with the first power source to being in contact with the second power source. The transfer element may be spring-mounted to the shaft, which ensures that a sufficient electrical contact exists between the surfaces of the transfer element and the respective leads of the first and second power sources, regardless of any wear or degradation that may be experienced at any of the surfaces.

21 Claims, 14 Drawing Sheets

(56) References Cited * cited by examiner

U.S. PATENT DOCUMENTS

| | | | | |
|---|---|---|---|---|
| 7,557,683 | B1 | 7/2009 | Wang | |
| 7,667,154 | B2 * | 2/2010 | Dolinski | 200/400 |

SOLENOID-DRIVEN AUTOMATIC TRANSFER SWITCH

TECHNICAL FIELD

The systems and methods of the present disclosure relate to electrical switching equipment and, more particularly, to automated electrical switching equipment for transferring one or more electrical loads from one power source to another power source in the event of a power failure or other casualty.

BACKGROUND

Many electrical loads are aligned to receive electrical power from multiple sources (i.e., from both a normal power supply and a backup power supply), such that a power failure or casualty associated with one power source does not preclude the electrical loads from operating with power from another power source. Where an electrical load is particularly vital, an automatic bus transfer switch may be installed to automatically transfer the electrical load from one power source to another power source, such as from a normal source to a standby source (e.g., a backup generator or supplemental power supply).

The ability to transfer one or more loads from a first power source to a second power source may require fast-acting transfer components that are designed to quickly open a connection between the loads and the first power source, and close a connection between the loads and the second power source, in a sufficiently short period of time to ensure that the loads remain energized in the event of a power failure or casualty associated with the first power source.

For significantly large loads, including high-voltage or high-power three-phase alternating current (AC) loads, the equipment for providing power to such loads from multiple power supplies typically includes heavy-duty conductive bus bars or contacts. Because automatic transfer switches typically require the rapid opening and closure of such assemblies in a moment's notice, the physical effects of arcing, sparking, friction or other adverse effects experienced by such transfer switches during normal operation may result in an uneven or unpredictable degradation of such assemblies over time. Moreover, where the electrical loads are intended to operate in rugged, ever-changing and unstable environments, such as those encountered aboard a maritime vessel, such a transfer switch must provide reliable means for ensuring that power is transferred from the first power source to the second power source time and time again, regardless of the extent of the wear or degradation of any of the components of the transfer switch.

SUMMARY OF THE PRESENT DISCLOSURE

The present disclosure is directed to automatic transfer switches for transferring electrical loads from a normal (or primary) power source to an alternate (or secondary) power source in the event of an unexpected power failure or casualty associated with the normal (or primary) power source. Specifically, according to some embodiments of the present disclosure, an automatic transfer switch may include at least one transfer element or rocker mounted to a shaft, wherein the transfer element or rocker includes a normal (or primary) transfer contact and an alternate (or secondary) transfer contact, and a load connection in electrical communication with the transfer element. When power from the normal power source is available, the shaft is positioned such that the normal transfer contact is electrically connected to a normal (or primary) source contact associated with the normal power source. Upon a loss of power from the normal power source, a solenoid-actuated operator causes a rotation or repositioning of the shaft and the transfer element about the axis, thereby opening the electrical connection between the normal source contact and the normal transfer contact, and closing an electrical connection between the alternate source contact and an alternate (or secondary) transfer contact associated with the alternate power source.

The systems and methods disclosed herein provide numerous advantages over switching systems and methods of the prior art. For example, the transfer switches of the present disclosure may be used to transfer large electrical loads (including but not limited to large three-phase AC power loads, such as large inductive motors) from a normal power source to an alternate power source in a very short period of time, so as to ensure the continued operability of the loads in the event of a power failure or other casualty associated with the normal source. Next, the transfer switches of the present disclosure also include features which enable the switches to be consistently and reliably operated in unstable environments, such as those encountered by shipboard electrical systems operating at sea, or in heavy industrial applications. For example, the components of the transfer switches may be configured about an axis or centroid such that the components are evenly mass-centered, thereby providing greater stability to the transfer switches during operation, such that the masses of the respective components of the transfer switches remain equally counterweighted about the axis or centroid regardless of the positions or alignments of the transfer switches. In particular, some embodiments of the transfer switches disclosed herein may include flexible conductors shaped in the form of continuous loops that may be installed or otherwise mounted above or about the axis or centroid, thereby ensuring that the masses of the conductors remains evenly distributed regardless of the position and/operational status of the transfer switch. Finally, the transfer switches of the present disclosure may include free-floating transfer contacts that are spring-loaded or otherwise biased into the normal or alternate power source contacts, depending on the position of the transfer switch, thereby ensuring that an adequate electrical connection is provided between the respective power source and the transfer switch regardless of any degradation or wear that may be experienced by any of the contacts.

According to one embodiment of the present disclosure, the various components of the transfer switch may be mass-centered about an axis defined by the shaft. In such a manner, the rotation of the shaft may be provided in an even and predictable manner, regardless of the orientation of the transfer switch, and may be based solely on the forces that are initiated by an automatic operator and transferred to the shaft through a transfer operator. The mass-centered nature of the transfer switches disclosed herein is particularly valuable where the transfer switches are employed in unstable environments that may be subject to irregular or erratic changes in orientation, such as in shipboard environments, where extreme shock or vibration events may be common. It has been observed that some of the embodiments of the present disclosure may continue to provide power to loads from a normal or alternate source even while experiencing multidimensional shocks of up to two hundred times the force of gravity (i.e., 200 G).

Second, according to other embodiments of the present disclosure, the transfer elements or rockers may be fixed or mounted to the shaft in a free-floating manner, and may be spring-mounted to an extension or appendage of the shaft, such as a platform. The shaft may then be designed to rotate or otherwise operate in a shearing, overtravel condition, such that the shaft may be initially adapted to rotate or travel beyond positions that would be ordinarily required to place the transfer elements in electrical contact with the leads of the normal or alternate power sources. Thus, as the contacts of the transfer elements or leads of the normal or alternate power sources degrade or wear due to arcing, sparking, friction or other adverse effects encountered during normal operation, or as the dimensions of the contacts change for any reason, the free-floating, spring-mounted transfer elements may remain biased into contact with the source contacts upon a rotation of the shaft regardless of the extent of any degradation or wear. Furthermore, as the contacts move from being open to being closed in a shearing manner, the contacts are subjected to a wiping action that cleans the respective contacting surfaces of each of the contacts, and thereby maintains a low contact resistive path for the current passing through the contacts. The springs within the spring-mounted elements also remain compressed to ensure that the transfer contacts remain overly biased into the source contacts.

Next, according to other embodiments of the present disclosure, the conductors that extend between the load connections and the transfer elements may be provided in a flexible, arcuate manner. The conductors may be formed in flexible and continuous, open loops, and may include ferrules, apertures or other features for mounting the conductors to the transfer elements and also to a load assembly including the one or more load connections. Moreover, the conductors may be positioned or oriented above or about an axis defined by the shaft to which the transfer elements are mounted, to ensure that the conductors, like the other components of the transfer switch, remain mass-centered. Such continuous loop flexible conductors ensure that the forces that may be required to move the transfer switch between its normal and alternate positions, and the masses of the components of the transfer switch, remain both balanced and equal during operation.

According to still other embodiments of the present disclosure, the automatic transfer switches may be operated by a solenoid assembly that causes the shaft to rotate in the event of a casualty or loss of power to one or more power sources. The solenoid may include one or more coils that may be energized by signals received from one or more controllers or external sources, which cause the movement of a solenoid rod or plunger that may be mechanically connected to the shaft. Thus, when the solenoid is energized, the shaft will rotate, and the electrical loads of the load assembly will be rapidly transferred from one power source to another. The solenoid may include one or more springs or other adjustable features for controlling the rate of movement of the rod or plunger, and, therefore, the rate at which the shaft may rotate, and the rate at which the loads are transferred from one power source to another.

According to another embodiment of the present disclosure, the transfer switches may be provided with position indicating systems, which may include relay switches or other features for monitoring the position of the shaft and/or the transfer elements, as well as the positions of one or more manual operators. Because the rotation of the shaft causes the transfer elements to move from contacting a first set of source contacts to contacting a second set of source contacts, determining the position of the shaft and/or the transfer elements effectively identifies the power source from which the loads are being powered through the transfer switches.

According to one other embodiment of the present disclosure, a method for providing power to an electrical load may comprise providing a solenoid-driven automatic transfer switch in accordance with the present disclosure, wherein the switch includes a solenoid that is adapted to withdraw a solenoid plunger that is mechanically linked to a main shaft in response to an energization of a solenoid coil. The automatic transfer switch is adapted to receive power from a primary and a secondary source, and to provide power to the electrical load, through a transfer element that may be repositioned by the main shaft. When the transfer switch is aligned to provide electrical power to the load from the primary source, the status of the availability of power at both the primary source and the secondary source may be sensed or otherwise monitored by standard means. If a power failure or other form of casualty afflicts the primary source, and if power is available from the secondary source, a signal may be sent to a solenoid from an external controller, thereby causing the main shaft to rotate the transfer element and to begin powering the electrical load from the secondary source.

DETAILED DESCRIPTION

Figure 1:
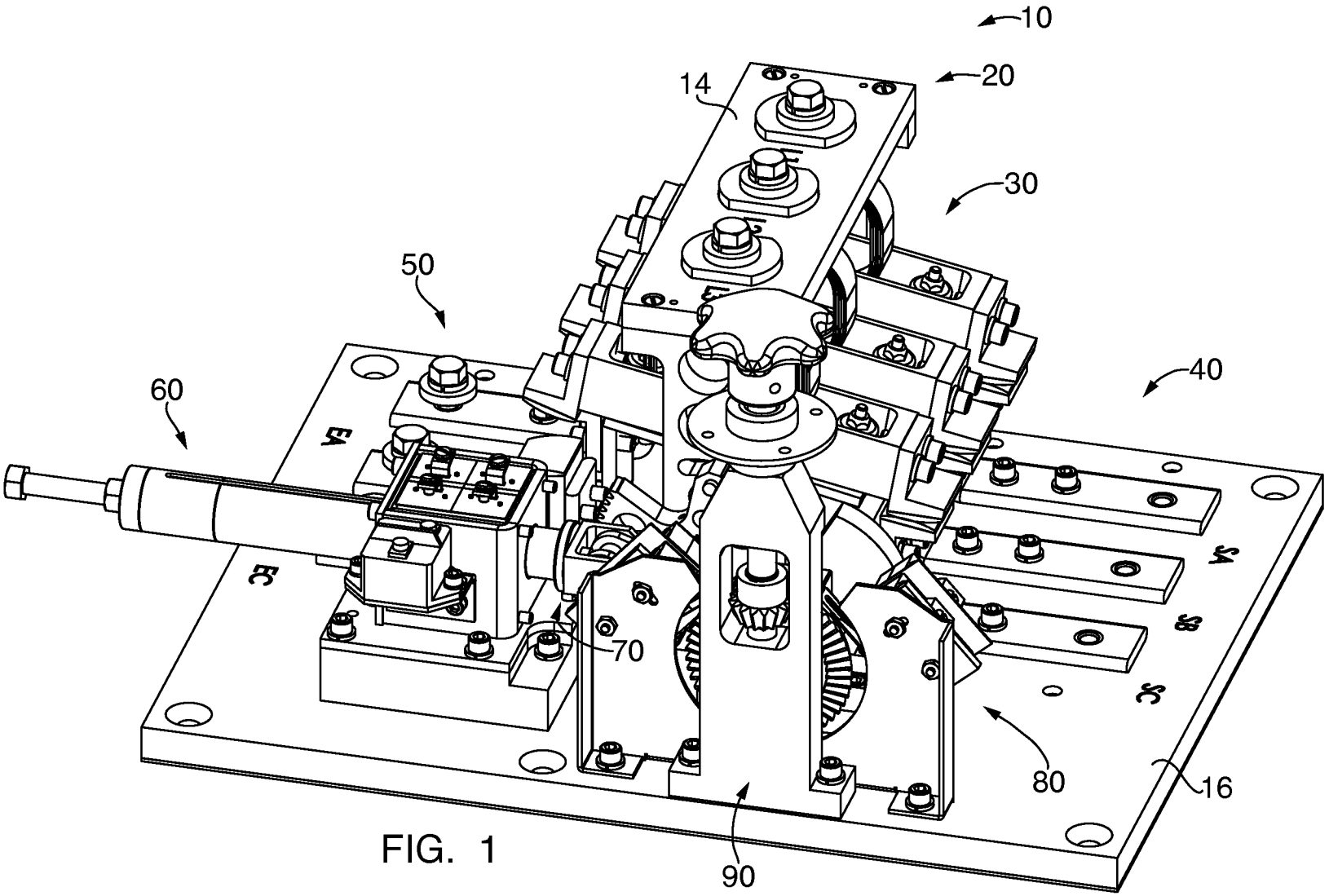
FIG. 1 is a right perspective view of an automatic transfer switch and components thereof, according to embodiments of the present disclosure.
Figure 2:
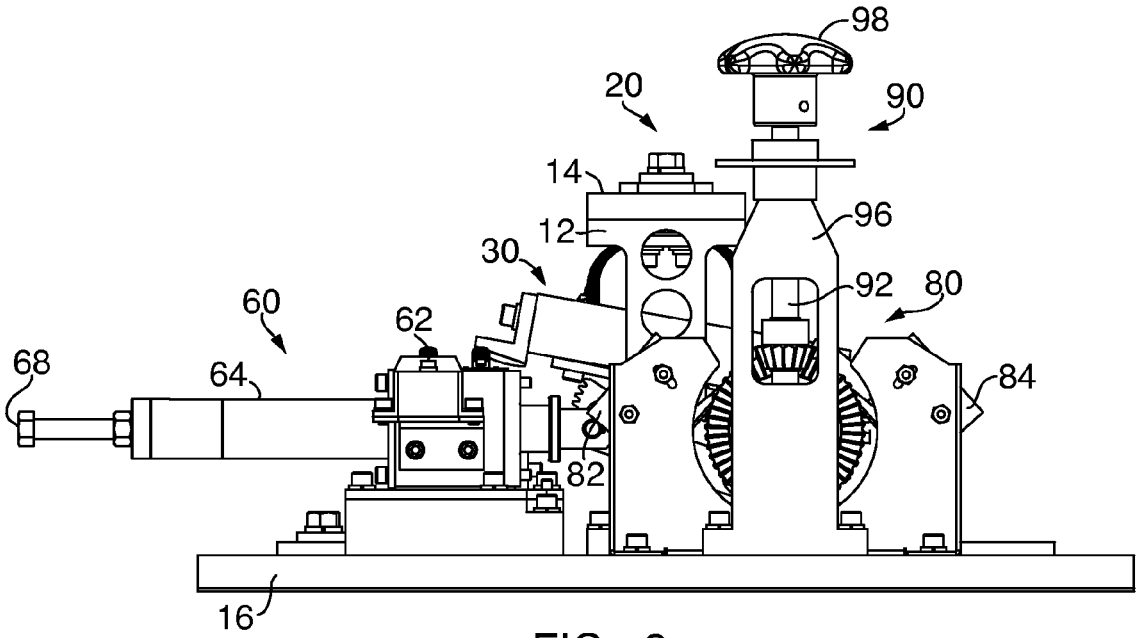
FIG. 2 is a right side view of the automatic transfer switch and components thereof shown in FIG. 1.
Figure 3:
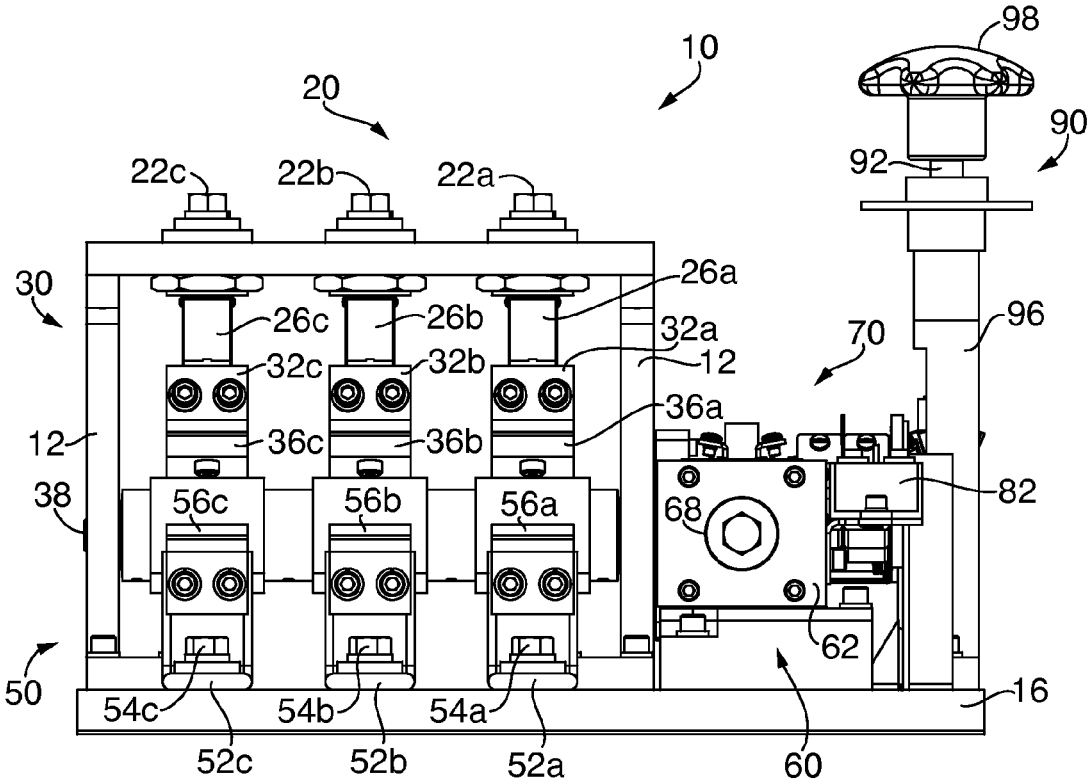
FIG. 3 is a bottom view of the automatic transfer switch and components thereof shown in FIG. 1.
Figure 4:
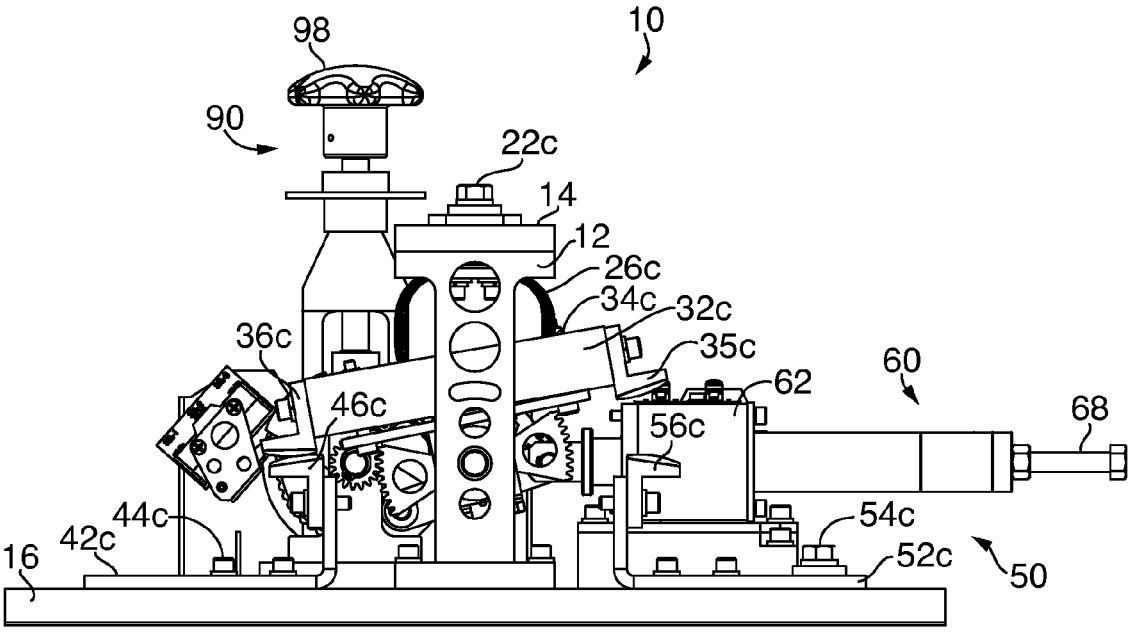
FIG. 4 is a left side view of the automatic transfer switch and components thereof shown in FIG. 1.
Figure 5:
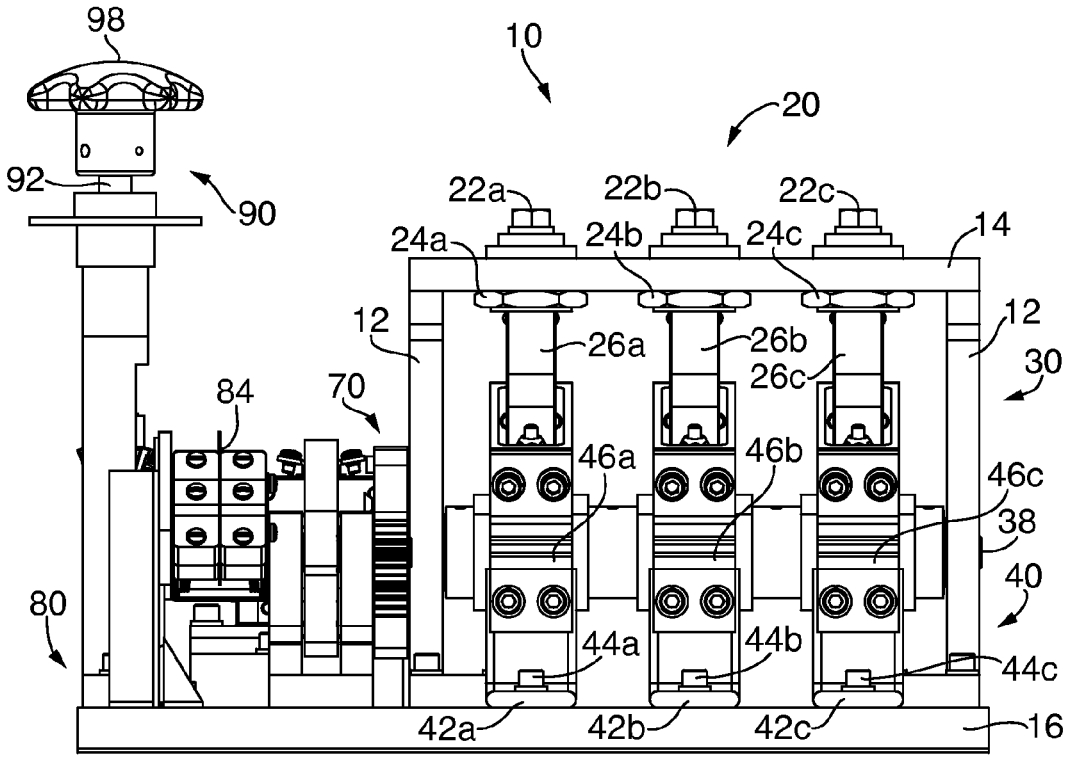
FIG. 5 is a top view of the automatic transfer switch and components thereof shown in FIG. 1.
Figure 6:
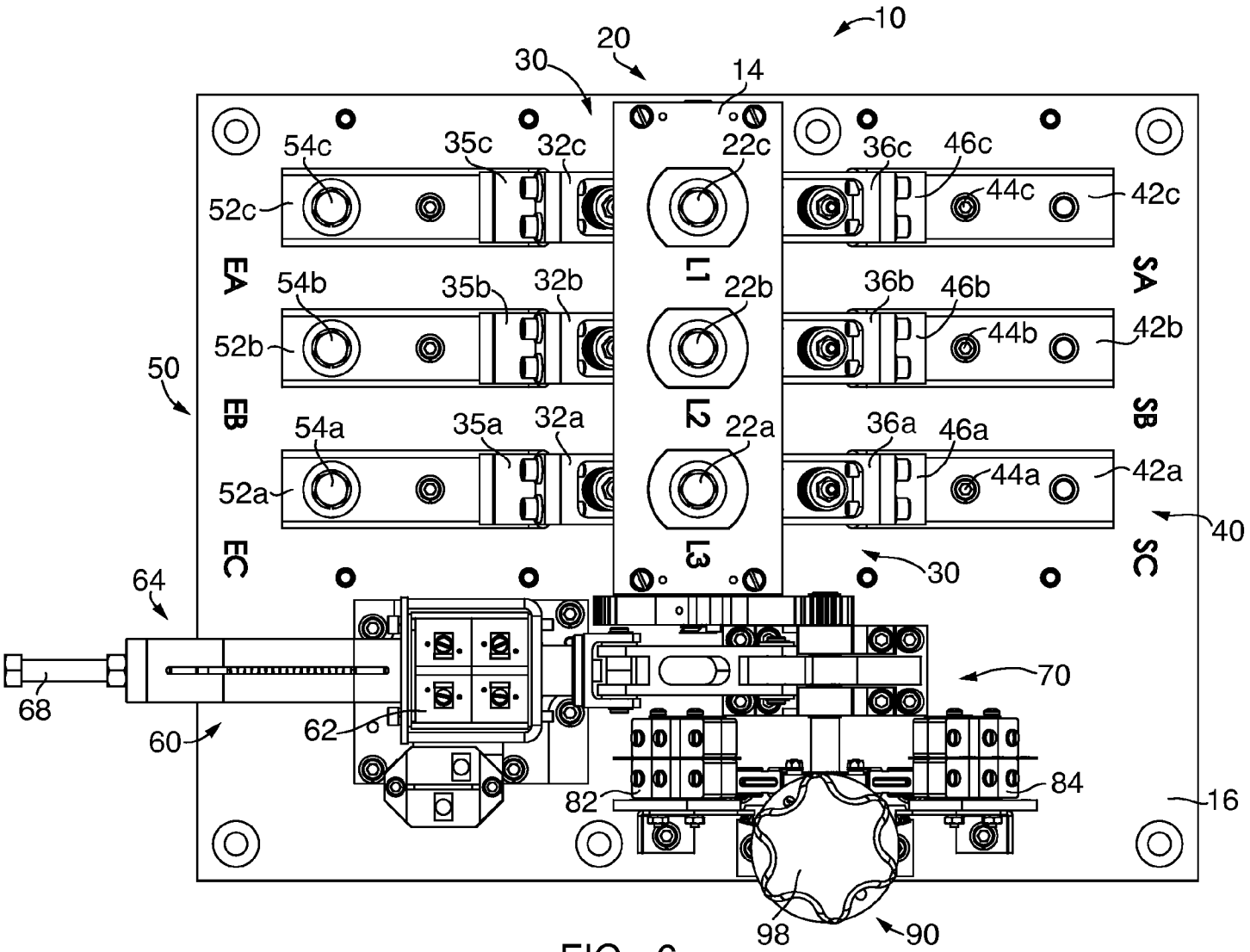
FIG. 6 is a front view of the automatic transfer switch and components thereof shown in FIG. 1.

Referring to FIGS. 1-6, an automatic transfer switch 10 according to embodiments of the present disclosure is shown.

The embodiment of the transfer switch 10 depicted in FIGS. 1-6 is generally intended to provide three-phase alternating current (AC) power from either a normal (or primary) power source or an alternate (or secondary) power source to a three-phase AC load. However, those of ordinary skill in the art would recognize that the systems and methods disclosed therein are not limited to providing AC power to loads, or to application in three-phase AC power environments, and may be utilized to provide AC power in any number of phases (e.g., single-phase) as well as direct current (DC) power to one or more loads.

As is depicted in FIGS. 1-6, the transfer switch 10 comprises a load assembly 20 for providing electrical power to one or more loads, and a transfer assembly 30 for switching the source of the power provided to the load assembly 20 from a normal side (or primary side) 40 to an alternate side (or secondary side) 50. Additionally, the transfer switch 10 also includes an automatic operator assembly 60 and a transfer operator assembly 70 for automatically operating the transfer switch 10. The transfer switch 10 further includes a position indicator assembly 80 for determining a position of the transfer switch 10, and a manual operator assembly 90 for operating the transfer switch 10 by manual means.

The transfer switch 10 depicted in FIGS. 1-6 also includes a frame 12, a load platform 14 and a source platform 16 for mounting the various components thereon. The load platform 14 and the source platform 16 may be formed from any suitable material, such as one or more insulating or composite plastic materials of sufficient strength and durability to provide structural support to the various components of the transfer switch 10.

The load assembly 20 is provided to transfer electrical power from the transfer assembly 30 to one or more loads. As is shown in the embodiment of the transfer switch 10 depicted in FIGS. 1-6, the load assembly 20 is adapted to provide three-phase AC power to the one or more loads, and comprises load contacts 22*a*, 22*b*, 22*c*, load fasteners 24*a*, 24*b*, 24*c*, flexible conductors 26*a*, 26*b*, 26*c*, and transfer fasteners 28*a*, 28*b*, 28*c*.

The load assembly 20 of the embodiment of the transfer switch 10 depicted in FIGS. 1-6 includes three combinations of load contacts, load fasteners, flexible conductors and transfer fasteners, with one combination for each AC phase, and each of the combinations is substantially identical. The load contacts 22*a*, 22*b*, 22*c* shown in FIGS. 1-6 are formed into open, continuous loops, and provide two releasable connections for linking the transfer switch 10 with the respective phases of the one or more loads that are intended to be powered from the normal side 40 or the alternate side 50 through the transfer switch 10. The flexible conductors 26*a*, 26*b*, 26*c* provide conductive paths between the respective transfer elements 32*a*, 32*b*, 32*c* and the load contacts 22*a*, 22*b*, 22*c*. The fasteners 24*a*, 24*b*, 24*c* connect the flexible conductors 26*a*, 26*b*, 26*c* to the load contacts 22*a*, 22*b*, 22*c*, and the fasteners 28*a*, 28*b*, 28*c* connect the flexible conductors 26*a*, 26*b*, 26*c* to the transfer elements 32*a*, 32*b*, 32*c*. In such a manner, the flexible conductors 26*a*, 26*b*, 26*c* provide durable, redundant and reliable conductive paths from either the normal side 40 or the alternate side 5, through the transfer elements 32*a*, 32*b*, 32*c* of the transfer assembly 30, and to the one or more loads that are connected to the load assembly 20 at the load connections 22*a*, 22*b*, 22*c*.

The load contacts 22*a*, 22*b*, 22*c* and the flexible conductors 26*a*, 26*b*, 26*c* may be created from any suitable conductive material in accordance with the present disclosure. Although the load contacts 22*a*, 22*b*, 22*c* are shown in FIGS. 1-6 as releasable hex head threaded connectors, those of ordinary skill in the art recognize that the load contacts 22*a*, 22*b*, 22*c* may include any form of device or feature that is suitable for connecting one or more loads to the transfer switch 10 that are known to those of ordinary skill in the art.

Likewise, the flexible conductors 26*a*, 26*b*, 26*c* may be created from any suitable conductive material in accordance with the present disclosure. Preferably, and as is depicted in FIGS. 1-6, the flexible conductors 26*a*, 26*b*, 26*c* are formed from tubes or toroids of thin copper strands that are meshed or braided and compressed into substantially flat articles before being shaped into the one or more rounded loops that provide conductive paths between the transfer elements 32*a*, 32*b*, 32*c* and the load contacts 22*a*, 22*b*, 22*c*, as is shown in FIGS. 1-6. The open, rounded shape of the flexible conductors 26*a*, 26*b*, 26*c* enhances the reliability of the transfer switch 10 in that each of the flexible conductors 26*a*, 26*b*, 26*c* provides two redundant conductive flow paths (rather than a single flow path) between the load contacts 22*a*, 22*b*, 22*c* and fasteners 24*a*, 24*b*, 24*c* and the transfer elements 32*a*, 32*b*, 32*c* and fasteners 28*a*, 28*b*, 28*c*. Moreover, the open, rounded shape of the flexible conductors 26*a*, 26*b*, 26*c* reduces both the extent of flow obstructions for ventilation or cooling of the internal components of the transfer switch 10, and also the resistive forces encountered during operation, while providing both a mechanically balanced conductive path between the load contacts 22*a*, 22*b*, 22*c* and the transfer elements 32*a*, 32*b*, 32*c*. According to one embodiment, the flexible conductors 26*a*, 26*b*, 26*c* are constructed of tinned copper braided leads.

Additionally, the flexible conductors 26*a*, 26*b*, 26*c* may include holes, perforations or other features to enable the conductors 26*a*, 26*b*, 26*c* to be mounted to the load contacts 22*a*, 22*b*, 22*c* or the transfer elements 32*a*, 32*b*, 32*c*, such as with fasteners 24*a*, 24*b*, 24*c* or fasteners 28*a*, 28*b*, 28*c*, respectively. Similarly, although the fasteners 24*a*, 24*b*, 24*c* and fasteners 28*a*, 28*b*, 28*c* are shown in FIGS. 1-6 as threaded brass connectors having hex sockets, those of ordinary skill in the art recognize that the fasteners 24*a*, 24*b*, 24*c* and fasteners 28*a*, 28*b*, 28*c* may be any form of fastener suitable for connecting conductive components that is known to those of ordinary skill in the art.

The transfer assembly 30 is provided to transfer electrical power from either the normal side 40 or the alternate side 50 to the load assembly 20. As is shown in the embodiment of the transfer switch 10 depicted in FIGS. 1-6, the transfer assembly 30 is a rotatable assembly comprising a plurality of transfer elements 32*a*, 32*b*, 32*c* mounted to a main shaft 38 that defines an axis. The transfer assembly 30 is adapted to rotate about the axis in order to transfer the one or more loads of the load assembly 20 from the normal side 40 to the alternate side 50, or vice versa. In the transfer assembly 30 of FIGS. 1-6, the transfer elements 32*a*, 32*b*, 32*c* are spring-mounted to the respective platforms 37*a*, 37*b*, 37*c* with spring connectors 33*a*, 33*b*, 33*c* and spring connectors 34*a*, 34*b*, 34*c*. Additionally, as is also depicted in FIGS. 1-6, each of the transfer elements 32*a*, 32*b*, 32*c* includes a normal transfer contact 36*a*, 36*b*, 36*c* for making electrical contact with a normal source contact 46*a*, 46*b*, 46*c* of the normal side 40, and an alternate transfer contact 35*a*, 36*b*, 36*c* for making electrical contact with an alternate source contact 56*a*, 56*b*, 56*c* of the alternate side 50.

The shaft 38 may be supported and mounted for rotation by any appropriate structural elements, such as the frame 12 shown in FIGS. 1-6. Additionally, the transfer elements 32*a*, 32*b*, 32*c* may be formed from any suitable, conductive material that provides sufficient strength and durability to withstand the rigorous contacting effects experienced during operation, such as arcing, sparking or friction, when the transfer elements 32*a*, 32*b*, 32*c* rotate to transfer the one or more loads from the normal side 40 to the alternate side 50, or vice versa. Preferably, the transfer elements 32*a*, 32*b*, 32*c* are formed, casted or machined from one or more copper-zinc alloys, such as brass, but may be formed from any other conductive material or alloy. In the embodiment of the transfer switch 10 shown in FIGS. 1-6, the transfer elements 32*a*, 32*b*, 32*c* are shaped in the form of troughs or trenches, with the spring connectors 33*a*, 33*b*, 33*c* and spring connectors 34*a*, 34*b*, 34*c* connecting the transfer elements 32*a*, 32*b*, 32*c* to the platforms 37*a*, 37*b*, 37*c* through a lower surface of the troughs or trenches. Additionally, the transfer contacts 35*a*, 35*b*, 35*c*, 36*a*, 36*b*, 36*c* may also be formed from any suitable conductive material, such as brass. Further, the transfer elements 32*a*, 32*b*, 32*c* may be mounted to the shaft 38 by any means, including the spring-mounted connections to the platforms 37*a*, 37*b*, 37*c* that are depicted in FIGS. 1-6, or by any other type of connection. Moreover, although the platforms 37*a*, 37*b*, 37*c* are shown as separate elements mounted to the shaft 38, which is formed of an insulating material, thereby electrically isolating the respective transfer elements 32*a*, 32*b*, 32*c* from one another, the transfer elements 32*a*, 32*b*, 32*c* may be adapted to rotate between positions corresponding to the normal side 40 or the alternate side 50 in any manner. For example, each of the transfer elements 32*a*, 32*b*, 32*c* may be spring-mounted to a single platform formed of an insulating material that may be mounted to the shaft 38, or may be spring-mounted directly to the shaft 38.

The normal side 40 provides electrical power from a normal power source (not shown) to the load assembly 20 through the transfer assembly 30. As is shown in the embodiment of the transfer switch 10 depicted in FIGS. 1-6, the normal side 40 includes a plurality of normal power leads 42*a*, 42*b*, 42*c* for making power available to the one or more loads that are connected to the load assembly 20 from the normal power source. As is also depicted in FIGS. 1-6, each of the normal power leads 42*a*, 42*b*, 42*c* is mounted to the source platform 16 with normal power fasteners 44*a*, 44*b*, 44*c*, and further includes a normal side contact 46*a*, 46*b*, 46*c* for making electrical contact with a normal transfer contact 36*a*, 36*b*, 36*c* of the transfer assembly 30. When each of the normal side contacts 46*a*, 46*b*, 46*c* of the normal side 40 is in contact with one of the normal transfer contacts 36*a*, 36*b*, 36*c* of the transfer assembly 30, the one or more loads that are connected to the load assembly 20 are aligned to receive three-phase AC power from a normal power source.

Similarly, the alternate side 50 provides electrical power from an alternate power source (not shown) to the load assembly 20 through the transfer assembly 30. As is shown in the embodiment of the transfer switch 10 depicted in FIGS. 1-6, the alternate side 50 includes a plurality of alternate power leads 52*a*, 52*b*, 52*c* for making power available to the one or more loads that are connected to the load assembly 20 from the alternate power source. As is also depicted in FIGS. 1-6, each of the alternate power leads 52*a*, 52*b*, 52*c* is mounted to the source platform 16 with alternate power fasteners 54*a*, 54*b*, 54*c*, and further includes an alternate side contact 56*a*, 56*b*, 56*c* for making electrical contact with an alternate transfer contact 35*a*, 36*b*, 36*c* of the transfer assembly 30. When each of the alternate side contacts 56*a*, 56*b*, 56*c* of the alternate side 50 is in contact with one of the alternate transfer contacts 35*a*, 35*b*, 35*c* of the transfer assembly 30, the one or more loads connected to the load assembly 20 are aligned to receive three-phase AC power from the alternate power source.

The components of the normal side 40 and the alternate side 50 may be formed from any suitable materials known to those of ordinary skill in the art. For example, the normal power leads 42*a*, 42*b*, 42*c* and the alternate power leads 52*a*, 52*b*, 52*c* may be formed from a substantially rigid conductor, such as bars, rods or casting formed from alloys including copper (e.g., brass) or aluminum. Additionally, the normal power fasteners 44*a*, 44*b*, 44*c* and the alternate power fasteners 54*a*, 54*b*, 54*c* may be any form of substantially rigid conducting element for mounting the normal power leads 42*a*, 42*b*, 42*c* and the alternate power leads 52*a*, 52*b*, 52*c* to the source platform 16, and/or for connecting leads from the normal and alternate power sources to the normal side 40 and the alternate side 50, respectively. Although the normal power fasteners 44*a*, 44*b*, 44*c* and the alternate power fasteners 54*a*, 54*b*, 54*c* are shown as releasable hex head threaded connectors, those of ordinary skill in the art will recognize that any type or form of conductive fastener for mounting the normal power leads 42*a*, 42*b*, 42*c* and the alternate power leads 52*a*, 52*b*, 52*c* to the source platform 16, or for connecting the normal power source or the alternate power source to the normal side 40 or the alternate side 50, respectively, may be utilized in accordance with the systems and methods of the present disclosure.

As is depicted in FIGS. 1-6, the respective sets of spring connectors 33*a*, 33*b*, 33*c* and 34*a*, 34*b*, 34*c* are used to spring-mount the transfer elements 32*a*, 32*b*, 32*c* to the platforms 37*a*, 37*b*, 37*c* that are fixed to the shaft 38. The rotation of the shaft 38 causes the transfer elements 32*a*, 32*b*, 32*c* to operate in a shearing manner, lifting the transfer elements 32*a*, 32*b*, 32*c* from the normal power leads 42*a*, 42*b*, 42*c*, and placing the transfer elements 32*a*, 32*b*, 32*c* in contact with the alternate power leads 52*a*, 52*b*, 52*c*, or vice versa. The spring connectors 33*a*, 33*b*, 33*c* and 34*a*, 34*b*, 34*c* permit the transfer elements 32*a*, 32*b*, 32*c* to rotate in a free-floating manner with respect to the shaft 38 and the platforms 37*a*, 37*b*, 37*c*. In this regard, the shaft 38 may be initially configured to overtravel beyond the ordinary contact positions with the normal power leads 42*a*, 42*b*, 42*c* and the alternate power leads 52*a*, 52*b*, 52*c*, such that the transfer elements 32*a*, 32*b*, 32*c* releasably lift from platforms 37*a*, 37*b*, 37*c* as the normal transfer contacts 36*a*, 36*b*, 36*c* are placed in contact with the normal power leads 42*a*, 42*b*, 42*c*, or as the alternate transfer contacts 35*a*, 35*b*, 35*c* are placed in contact with the alternate power leads 52*a*, 52*b*, 52*c*. As is discussed above, however, the transfer elements 32*a*, 32*b*, 32*c* may be adapted to rotate between the normal side 40 and the alternate side 50 in any manner, such as by spring-mounting each of the elements to a single platform formed of an insulating material and mounted to the shaft 38, or by spring-mounting the transfer elements 32*a*, 32*b*, 32*c* directly to the shaft 38.

During operation, the spring connectors 33*a*, 33*b*, 33*c* and 34*a*, 34*b*, 34*c* ensure that the transfer elements 32*a*, 32*b*, 32*c* are placed in sufficient contact with the leads of either the normal side 40 or the alternate side 50, respectively. For example, when the normal transfer contacts 36*a*, 36*b*, 36*c* are placed in contact with the normal power leads 46*a*, 46*b*, 46*c*, the spring connectors 33*a*, 33*b*, 33*c* will persistently bias the transfer elements 32*a*, 32*b*, 32*c* into the normal power leads 46*a*, 46*b*, 46*c* to ensure that a sufficient conductive path exists between the normal side 40 and the load assembly 20 through the transfer assembly 30. Likewise, when the alternate transfer contacts 35*a*, 35*b*, 35*c* are placed in contact with the alternate power leads 56*a*, 56*b*, 56*c*, the spring connectors 34*a*, 34*b*, 34*c* will persistently bias the transfer elements 32*a*, 32*b*, 32*c* into the alternate power leads 56*a*, 56*b*, 56*c* to ensure that a sufficient conductive path exists between the alternate side 50 and the load assembly 20 through the transfer assembly 30. Therefore, as the surfaces of the contacts and leads degrade or wear due to friction or electrical phenomena such as arcing or sparking, the spring connections 33*a*, 33*b*, 33*c* or 34*a*, 34*b*, 34*c* ensure that the transfer elements 32*a*, 32*b*, 32*c* will remain in contact with either the normal power leads 42*a*, 42*b*, 42*c* or the alternate power leads 52*a*, 52*b*, 52*c*, respectively, depending on the position of the shaft 38, and regardless of any degradation or wear experienced by any of the contacts or leads.

The automatic operator assembly 60 is provided to automatically cause a rotation of the shaft 38 in the event of a power casualty affecting the source of power to the load assembly 20, thereby transferring the one or more loads of the load assembly 20 from the normal side 40 to the alternate side 50, or vice versa. As is shown in the embodiment of the transfer switch 10 depicted in FIGS. 1-6, the automatic operator assembly 60 includes a solenoid 62, a solenoid plunger 64 having a forked yoke 65, a spring 66 for providing tension to or otherwise opposing the solenoid plunger 64, and an adjuster 68 for adjusting the level of tension or opposition provided by the spring 66 to the solenoid plunger 64.

The transfer operator assembly 70 is provided to cause a rotation of the shaft 38 based on a movement or withdrawal of the solenoid plunger 64. As is shown in the embodiment of the transfer switch 10 depicted in FIGS. 1-6, the transfer operator assembly 70 includes a linkage 72 having pivoted connections with the forked yoke 65 of the automatic operator assembly 60, and an inertial cam 73 mounted to an idler shaft 74. The idler shaft 74 is supported by an idler base 75 and includes a proximal end and a distal end. The distal end of the idler shaft 74 includes an idler gear 76 for meshing with an inertial gear 78 connected to the shaft 38. The proximal end of the idler shaft 74 includes an indicator cam 81 to be tracked by the position indicator assembly 80 and an idler manual gear 77 for meshing with a manual shaft gear 94 of the manual operator assembly 90. The idler gear 76 and the inertial gear 78 may have any gear ratio. According to one embodiment of the present disclosure, a 1:3 gear ratio is preferred.

The position indicator assembly 80 is provided to generate an indication of a position of the shaft 38 and, therefore, an indication as to whether the load assembly 20 is aligned to receive power from the normal side 40 or the alternate side 50. As is shown in the embodiment of the transfer switch 10 depicted in FIGS. 1-6, the position indicator assembly 80 includes an indicator cam 81 mounted to the proximal end of the idler shaft 74 and a pair of limit switches 82, 84 mounted to a frame 86. The limit switches 82, 84 correspond to respective positions of the idler shaft 74 and are adapted to ride about the indicator cam 81 as the idler shaft 74 rotates. For example, referring to the transfer switch 10 shown in FIGS. 1-6, the limit switch 82 provides an indication when the idler shaft 74 is in a position corresponding to the normal transfer contacts 36*a*, 36*b*, 36*c* of the transfer assembly 30 being electrically connected to the normal side contacts 46*a*, 46*b*, 46*c*, and the limit switch 84 provides an indication when the idler shaft 74 is in a position corresponding to the alternate transfer contacts 35*a*, 35*b*, 35*c* of the transfer assembly 30 being electrically connected to the alternate side contacts 56*a*, 56*b*, 56*c*. Any type of monitoring system may be used to monitor the position of the shaft 38 and/or the idler shaft 74, or the status of the power applied to the load assembly 20, in accordance with the systems and methods of the present disclosure.

The manual operator assembly 90 is provided to enable the operation of the transfer switch 10 by manual means. As is shown in the embodiment of the transfer switch 10 depicted in FIGS. 1-6, the manual operator assembly 90 includes a manual shaft 92, a manual shaft gear 94 mounted to the manual shaft 92, a manual frame 96 and a manual handwheel 98. The manual shaft gear 94 is adapted to mesh with the idler manual gear 77 of the idler shaft 74.

Figure 7A:
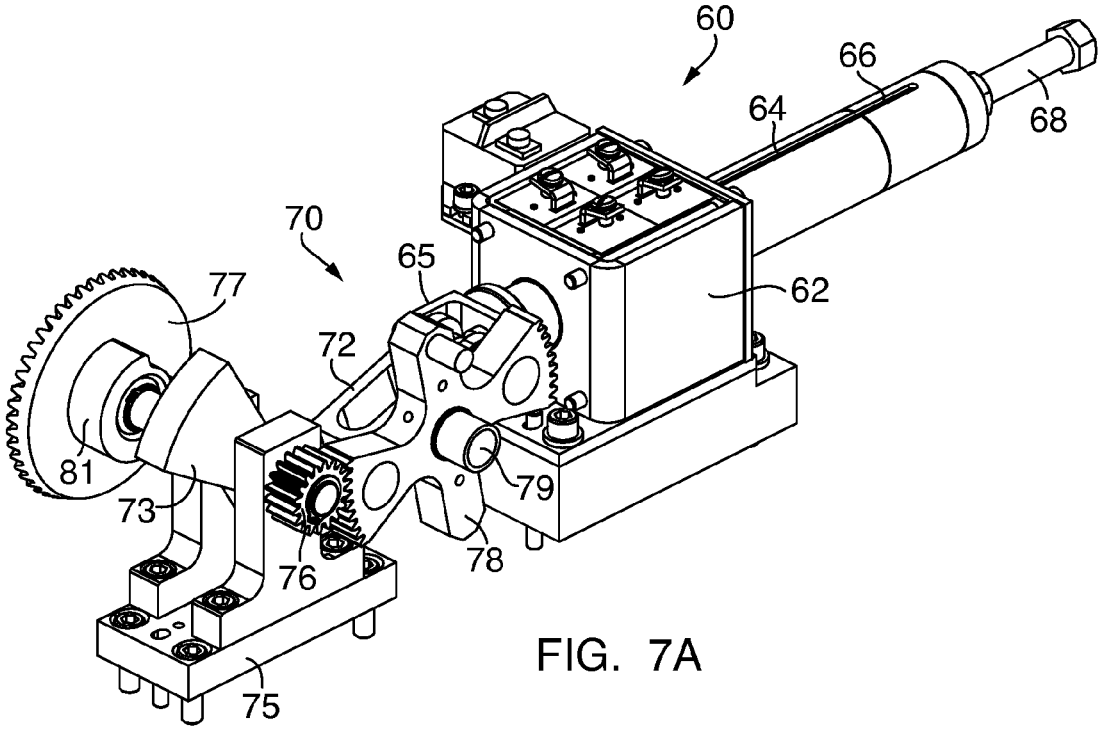
FIGS. 7A and 7B are perspective views of an automatic operator assembly and a transfer operator assembly, according to embodiments of the present disclosure.
Figure 7B:
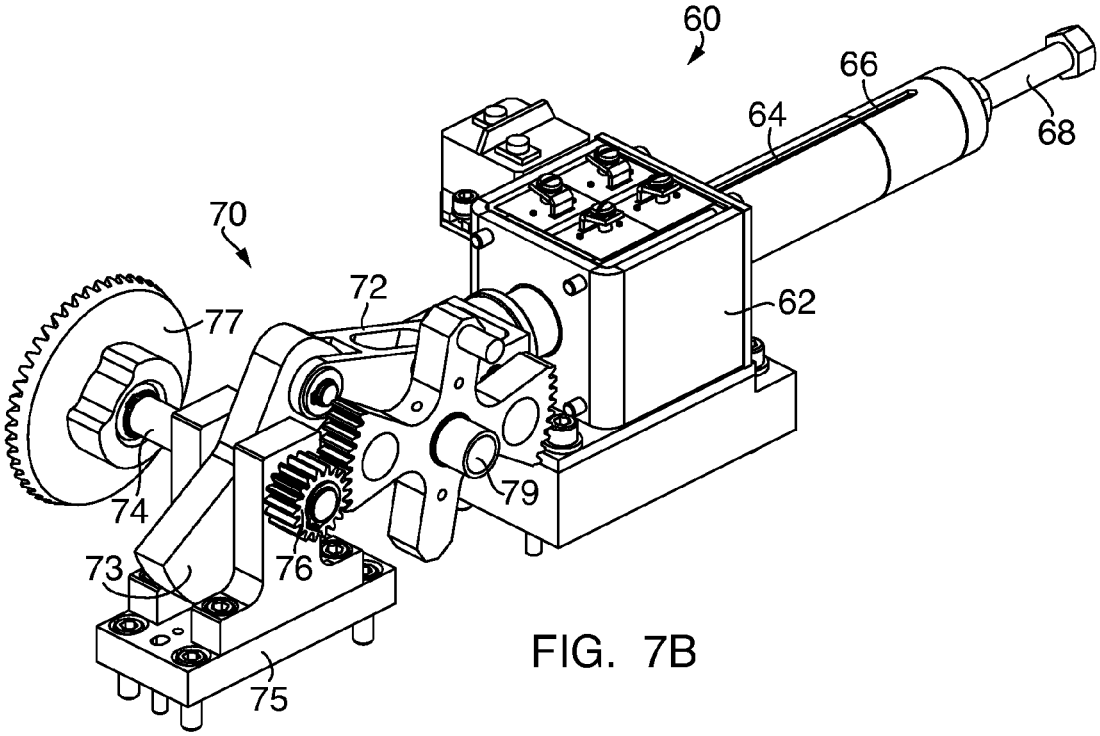

Referring to FIGS. 7A and 7B, perspective views of the interrelationships of the components of the automatic operator assembly 60 with the components of the transfer operator assembly 70 depicted in FIGS. 1-6 are shown. FIG. 7A corresponds to an alignment of the transfer switch 10 to receive power from the normal side 40, while FIG. 7B corresponds to an alignment of the transfer switch 10 to receive power from the alternate side 50. The automatic operator assembly 60 is shown as including the solenoid 62, the solenoid plunger 64 and the forked yoke 65, the spring 66 and the adjuster 68. The transfer operator assembly 70 is shown as including linkage 72, which is connected to the forked yoke 65 and the inertial cam 73 that is mounted to the idler shaft 74. The proximal end of the idler shaft 74 includes the indicator cam 81 and the idler manual gear 77. The distal end of the idler shaft 74 includes the idler gear 76, which meshes with the inertial gear 78 connected to the shaft 38.

During operation, upon the receipt of a signal from a controller (not shown), one or more coils (not shown) of the solenoid 62 may be energized for a predetermined period of time to generate a magnetic flux that causes the solenoid plunger 64 to recoil or withdraw in the direction of the spring 66, which pulls the linkage 72 toward the automatic operator assembly 60 and rotates the inertial cam 73 thereby. The rotation of the inertial cam 73 further causes the idler gear 76 to rotate the inertial gear 78 and to rotate the shaft 38, thereby repositioning the transfer element 32. Once the coils of the solenoid are no longer energized, the spring 66 forces the solenoid plunger 64 to return to its original position. Accordingly, by energizing one or more of the coils of the solenoid 62, the shaft 38 may be rotated, and the transfer switch 10 may transfer the one or more loads of the load assembly 10 from the normal side 40 to the alternate side 50, or vice versa. When the coils of the solenoid 62 are energized again, the process may reverse itself by again causing the solenoid plunger 64 to recoil or withdraw in the direction of the spring 66, thereby pulling the linkage 72 toward the automatic operator assembly 60, and rotating the inertial cam 73 thereby, to cause a reverse rotation of the shaft 38, and to again reposition the transfer element 32. The gears of the present disclosure, including but not limited to the idler gear 76, the idler manual gear 77, the inertial gear 78 or the manual shaft gear 94, may be formed in shapes of continuous circles, or in arcs or other portions of circles, as necessary. For example, the gears of the present disclosure may be segmented gears, and may take the form of fans or other like shapes. Additionally, such gears may be formed from any suitable industrial material, such as steels or other metal alloys.

Preferably, the automatic operator assembly 60 includes one or more solenoids for operating the transfer switch 10, such as the solenoid 62 shown in FIGS. 1-6, 7A and 7B, having one or more coils to be energized at approximately 600 volts (V) direct current (DC) from an external source, such as a controller. In order to move the transfer switch 10 from one position (i.e., aligned with the normal side 40 or the alternate side 50) to another (i.e., vice versa), voltages may be applied to the solenoid 62 to cause the solenoid plunger 64 and forked yoke 65 to draw toward the solenoid 62, in tension against the solenoid spring 66. The drawing motion of the forked yoke 65 toward the solenoid 62 causes the linkage 72 to rotate the inertial cam 73, which rotates the idler gear 76 and further causes the inertial gear 78 and shaft 38 to rotate thereby. For example, where the transfer switch 10, solenoid assembly 60 and transfer operator assembly 70 are positioned in accordance with FIG. 7A, applying voltage to the solenoid 62 causes the transfer switch 10, solenoid assembly 60 and transfer assembly 70 to be repositioned to the respective positions shown in FIG. 7B, and subsequently applying voltage again to the solenoid 62 causes the transfer switch 10, solenoid assembly 60 and transfer assembly 70 to be repositioned back to the respective positions shown in FIG. 7A.

The voltages applied to the solenoid 62 may derive directly from the available voltages of either the normal side 40 or the alternate side 50, or may be provided from one or more controllers or other external sources (not shown), e.g., a rectified alternating current (AC) signal, such as a rectified signal of approximately 440-450 volts (V) AC. However, solenoids of any type or configuration that may be energized by any appropriate voltage level, or any other type of automatic operator that may be adapted to cause a rotation of the shaft 38, and to thereby transfer the one or more electrical loads of the load assembly 20 from the normal side 40 to the alternate side 50, or vice versa, may be utilized in accordance with the systems and methods of the present disclosure.

Moreover, in a preferred embodiment, the voltages applied to the solenoid 62 and/or the tension provided to the solenoid plunger 64 by the spring 66 may be set or adjusted to ensure that the transfer switch operates in an adequate period of time in order to transfer the loads of the load assembly 20 from the normal side 40 to the alternate side 50, or vice versa. Preferably, an operation of the transfer switch 10 may be completed in approximately forty-eight (48) milliseconds (ms), although the time required to complete the operation may be determined based on the type of power provided, the applicable voltage and/or frequency levels and the applications in which the transfer switch 10 is utilized. Based on the high speed of operation and the mass-centered nature of the transfer assembly 30, the voltages applied to the solenoid 62 may be secured as the transfer assembly 30 is traveling between the normal side 40 and the alternate side 50, or vice versa, i.e., before any of the normal transfer contacts 36*a*, 36*b*, 36*c* make electrical contact with any of the normal source contacts 46*a*, 46*b*, 46*c* of the normal side 40, or before any of the alternate transfer contacts 35*a*, 35*b*, 35*c* make electrical contact with any of the alternate source contacts 56*a*, 56*b*, 56*c* of the alternate side 50. Even with the solenoid voltages secured, the momentum generated by the solenoid 62 will cause the transfer assembly 30 to continue to travel until electrical contact is made.

Additionally, the spring-mounted nature of the transfer elements 32*a*, 32*b*, 32*c* in the transfer assembly 30 described above ensures that the contacts of one side will remain closed for a brief period of time as the operation of the transfer switch is initiated, and that the contacts of the other side will begin to close before the operation of the transfer switch is completed. For example, in such embodiments, where the transfer elements 32*a*, 32*b*, 32*c* are aligned to power the loads of the load assembly 20 from the normal side 40, the normal transfer contacts 36*a*, 36*b*, 36*c* may remain in contact with the normal source contacts 42*a*, 42*b*, 42*c* for up to approximately fifteen (15) milliseconds (ms) after an operation of the transfer switch 10 commences, and the alternate transfer contacts 35*a*, 35*b*, 35*c* may begin to contact the alternate source contacts 52*a*, 52*b*, 52*c* up to approximately fifteen (15) milliseconds (ms) before the operation of the transfer switch 10 is completed. Therefore, in such embodiments, the transfer switch 10 may remain open for only approximately eighteen (18) milliseconds (ms) as power is transferred from the normal side 40 to the alternate side 50, or vice versa.

In a preferred embodiment, the solenoid 62 has both fixed and movable magnetic steel components that are formed to mate with another. The materials from which the solenoid 62 and/or the components thereof are formed may be specially formulated or selected to act as an electromagnet in order to draw the forked yoke 65 against the main spring 66, and to cause the idler shaft 74 to rotate the main shaft 38, and to cause the transfer assembly 30 to move from the normal side 40 to the alternate side 50, or vice versa. Preferably, the solenoid 60 is a bistate element, i.e., comprising two positions for placing the transfer switch in the normal or standard position and the alternate or emergency position, respectively. Other solenoids having multiple positions may be utilized in accordance with the systems and methods of the present disclosure.

In a preferred embodiment, the components of the automatic operator assembly 60 and the transfer operator assembly 70 are distributed about an axis or centroid defined by the shaft 38. For example, the masses and/or dimensions of the components of the transfer operator assembly 70, including the inertial cam 73 and the linkage 72, may be chosen to correspond to the masses of the components of the automatic operator assembly 60, including the solenoid plunger 64, the forked yoke 65, the spring 66 and/or the adjuster 68, in order to ensure that the components are evenly mass-centered on either side of the shaft 38. By counterweighting the components of the transfer switch 10 with respect to the axis defined by the shaft, the transfer switch 10 is more likely to operate in a consistent manner even where the transfer switch 10 is employed in unstable environments that may be subject to irregular or erratic changes in orientation, such as in shipboard environments at sea. For example, the counterweighting provides a static balance of the respective components, in order to mitigate any forces encountered during dynamic shock events, and to permit the transfer switch 10 to operate in any anticipated condition.

Referring to FIGS. 8A-8H, the interrelationship of the components of the transfer assembly 30 with the components of the load assembly 20, the normal side 40 and the alternate side 50 depicted in FIGS. 1-6 is shown. FIGS. 8A, 8C, 8E and 8G correspond to an alignment of the transfer switch 10 to receive power from the normal side 40, while FIGS. 8B, 8D, 8F and 8H corresponds to an alignment of the transfer switch 10 to receive power from the alternate side 50.

Figure 8A:
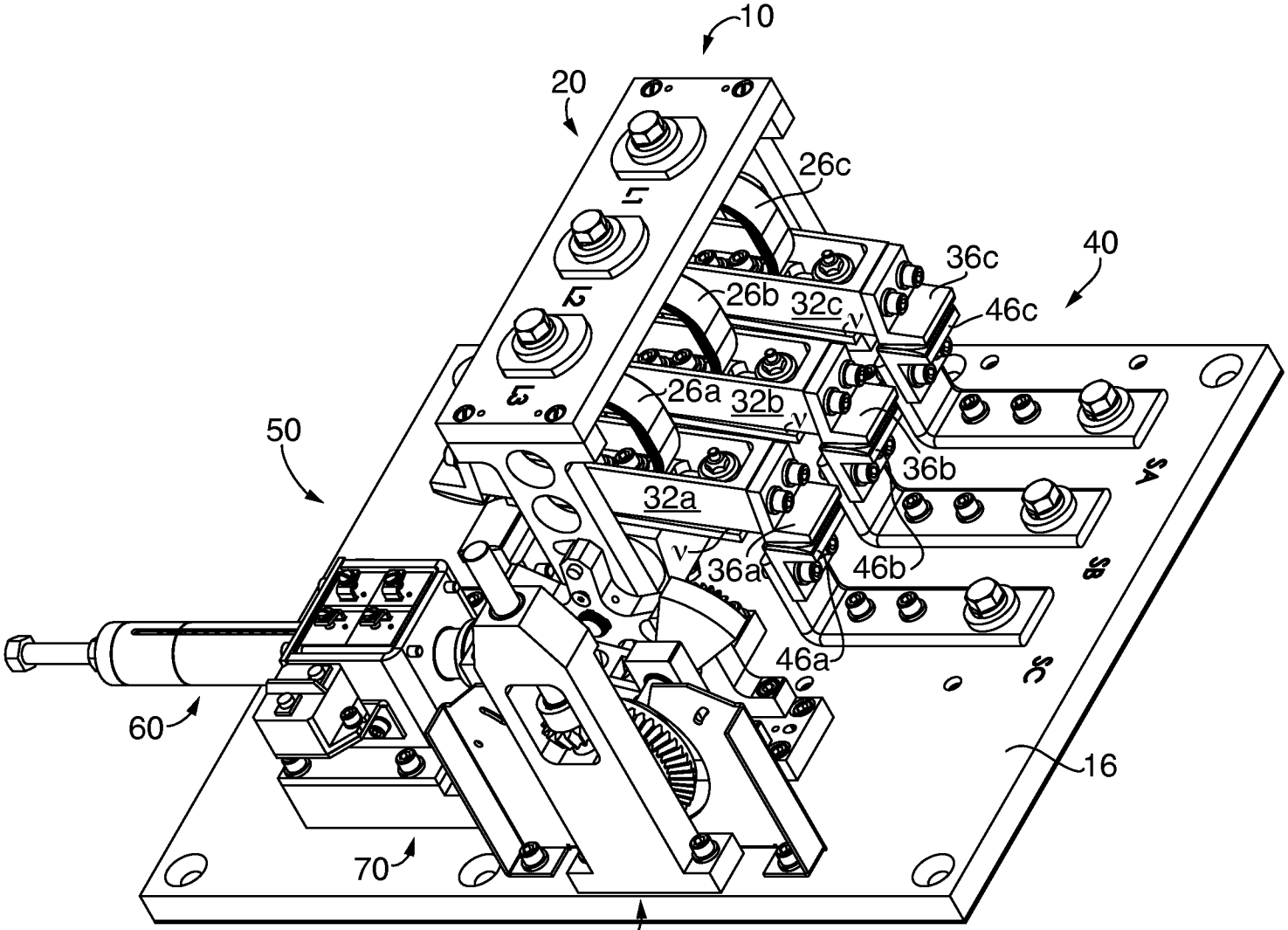
FIGS. 8A and 8B are perspective views of an automatic operator assembly, according to embodiments of the present disclosure.
Figure 8B:
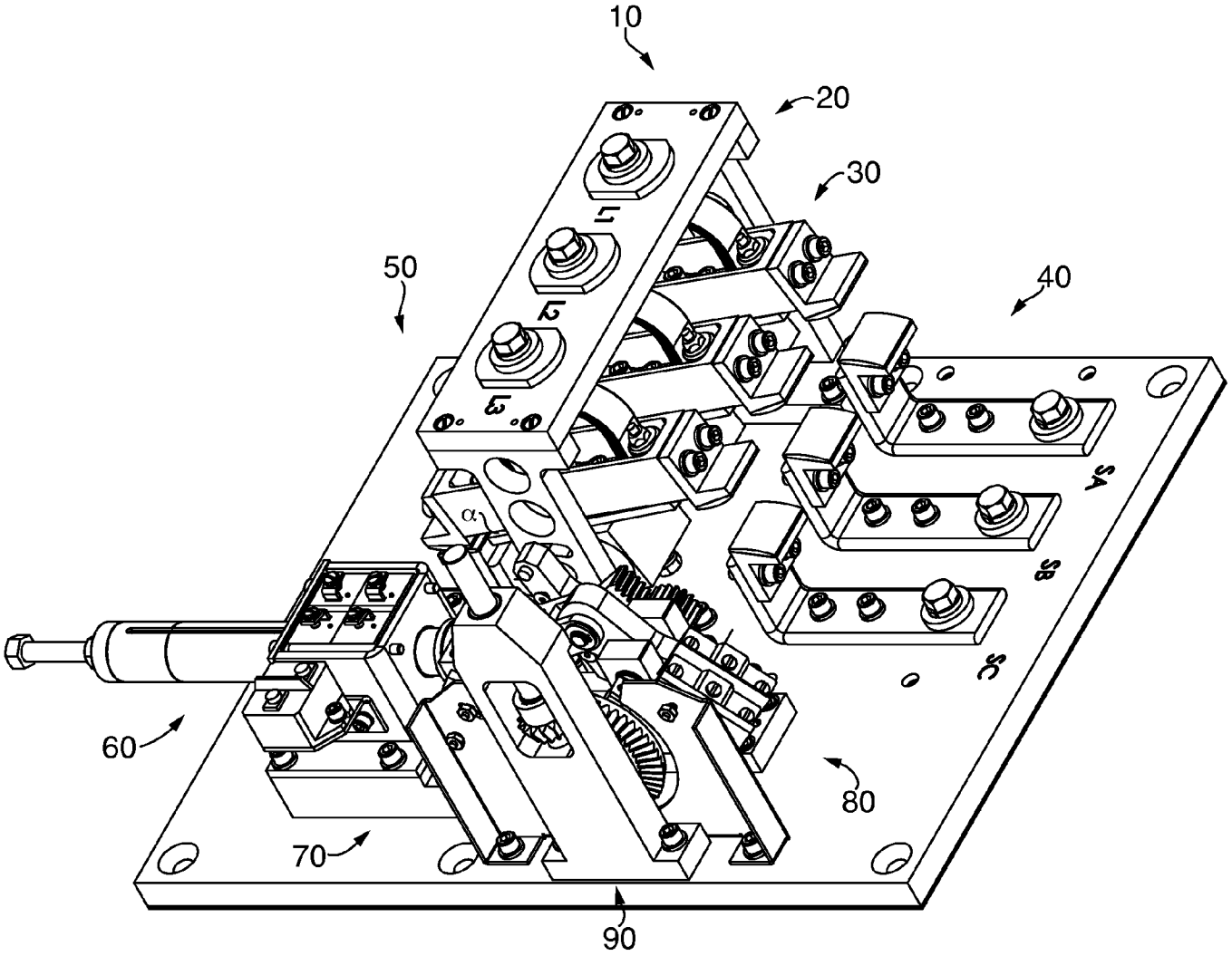

Referring to FIGS. 8A and 8B, the transfer assembly 30 is shown as including the three combinations of transfer elements 32*a*, 32*b*, 32*c*, the spring connectors 33*a*, 33*b*, 33*c* and 34*a*, 34*b*, 34*c*, the normal transfer contacts 36*a*, 36*b*, 36*c* and the alternate transfer contacts 35*a*, 35*b*, 35*c* that are spring-mounted to platforms 37*a*, 37*b*, 37*c* which are fixed to the shaft 38. As is shown in FIG. 8A, the normal transfer contacts 36*a*, 36*b*, 36*c* are in electrical contact with the normal source contacts 46*a*, 46*b*, 46*c* of the normal side 40. As is shown in FIG. 8B, the alternate transfer contacts 35*a*, 35*b*, 35*c* are in electrical contact with the alternate source contacts 56*a*, 56*b*, 56*c*. Accordingly, where the transfer switch 10, solenoid assembly 60 and transfer operator assembly 70 are positioned in accordance with FIG. 8A, applying voltage to the solenoid assembly 60 causes the transfer switch 10, solenoid assembly 60 and transfer assembly 70 to be repositioned to the respective positions shown in FIG. 8B, and subsequently applying voltage again to the solenoid assembly 60 causes the transfer switch 10, solenoid assembly 60 and transfer assembly 70 to be repositioned back to the respective positions shown in FIG. 8A.

Figure 8C:
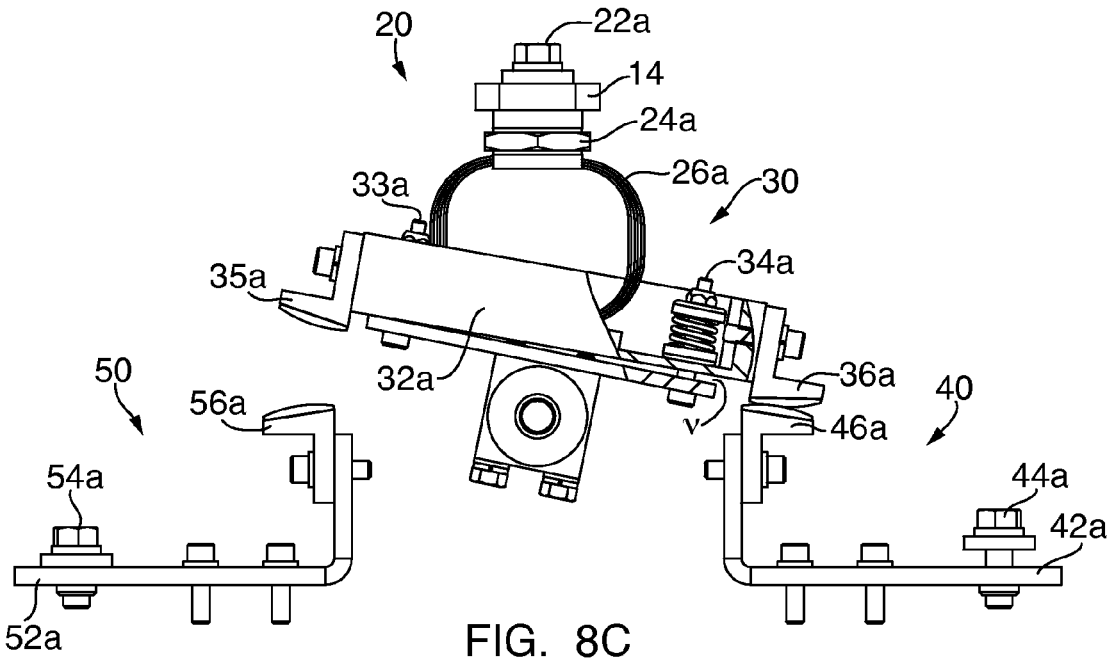
FIGS. 8C-8H are views of components of a power transfer assembly in respective operational conditions, according to embodiments of the present disclosure.

As is discussed above, the rotation of the shaft 38 causes the transfer switch 10 to transfer any loads that may be connected to the load assembly 20 from the normal side 40 to the alternate side 50, or vice versa. Referring to FIG. 8C, the transfer element 32*a* is shown in a first position, with the normal transfer contact 36*a* of the transfer assembly 30 placed in electrical contact with the normal source contact 46*a* of the normal side 40. When the shaft 38 is in the first position shown in FIG. 8C, the load assembly 20 is powered from the normal side 40 through a conductive path extending from the normal source contact 46*a* through the normal transfer contact 36*a*, the transfer element 32*a*, and the flexible conductor 26*a* to the load contact 22*a*. Additionally, according to the embodiment of the present disclosure shown in FIG. 8C, the normal transfer contact 36*a* may be biased into the normal source contact 46*a* by spring connector 33*a*, which ensures that a sufficient conductive path is provided between the load assembly 20 and the normal side 40 despite any wear or degradation that may have been experienced at either the normal transfer contact 36*a* or the normal source contact 46*a*.

Figure 8D:
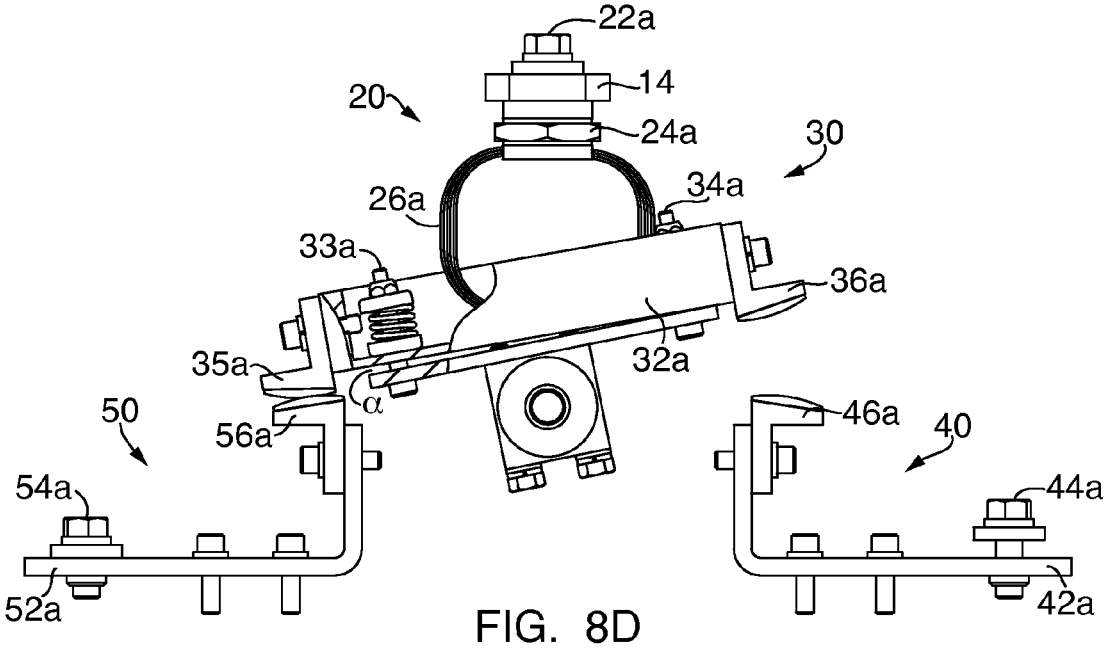

Referring to FIG. 8D, the transfer element 32*a* is shown following a shearing rotation of the shaft 38 from the first position to a second position, with the alternate transfer contact 35*a* placed in electrical contact with the alternate side 56*a*. When the shaft 38 is in the second position shown in FIG. 8D, the load assembly 20 is powered from the alternate side 50 through a conductive path extending from the alternate source contact 56*a* through the alternate transfer contact 35*a*, the transfer element 32*a* and the flexible conductor 26*a* to the load contact 22*a*. Likewise, according to the embodiment of the present disclosure shown in FIG. 8D, the alternate transfer contact 35*a* may be biased into the alternate source contact 56*a* by spring connector 34*a*, which ensures that a sufficient conductive path is provided between the load assembly 20 and the alternate side 50 despite any wear or degradation that may have been experienced at either the alternate transfer contact 35*a* or the alternate source contact 56*a*.

As is also discussed above, the shaft 38 may be configured to overtravel beyond the ordinary contact positions between the contacts of the transfer assembly 30 and the contacts of either the normal side 40 or the alternate side 50, respectively. Referring again to FIGS. 8A and 8B, the overtravel conditions of the shaft 38 are shown. Referring to FIG. 8A, an overtravel angle ν is shown between the transfer elements 32*a*, 32*b*, 32*c* and the respective platforms 37*a*, 37*b*, 37*c*, when the transfer switch 10 is aligned to receive power from the normal side 40. Referring to FIG. 8B, the overtravel angle α is shown between the transfer elements 32*a*, 32*b*, 32*c* and the respective platforms 37*a*, 37*b*, 37*c*, when the transfer switch 10 is aligned to receive power from the alternate side 50. Such overtravel conditions are caused when the respective contacts of the transfer elements 32*a*, 32*b*, 32*c* mate with the respective contacts of the normal side 40 or alternate side 50, respectively, thereby causing the transfer element 32*a*, 32*b*, 32*c* to lift from the respective platforms 37*a*, 37*b*, 37*c*, and to compress the associated spring connectors 33*a*, 33*b*, 33*c* or 34*a*, 34*b*, 34*c*.

Referring to FIGS. 8C-8H, side views of the transfer assembly 30 are shown with the transfer assembly 32*a* in contact with the normal side 40 and the alternate side 50, respectively. Referring to FIG. 8C, the transfer contact 36*a* of the transfer element 32*a* is shown in contact with the normal source contact 46*a*, and an overtravel angle ν is shown between the transfer element 32*a* and the platform 37*a*. The overtravel angle ν is formed as the transfer element 32*a* is lifted from the platform 37*a*, thereby compressing the spring-mounted connection 34*a* is shown in FIG. 8C. Conversely, referring to FIG. 8C, the transfer contact 35*a* of the transfer element 32*a* is shown in contact with the alternate source contact 56*a*, and an overtravel angle α is shown between the transfer element 32*a* and the platform 37*a*. The overtravel angle α is formed as the transfer element 32*a* is lifted from the platform 37*a*, thereby compressing the spring-mounted connection 33*a* is shown in FIG. 8D.

Figure 8E:
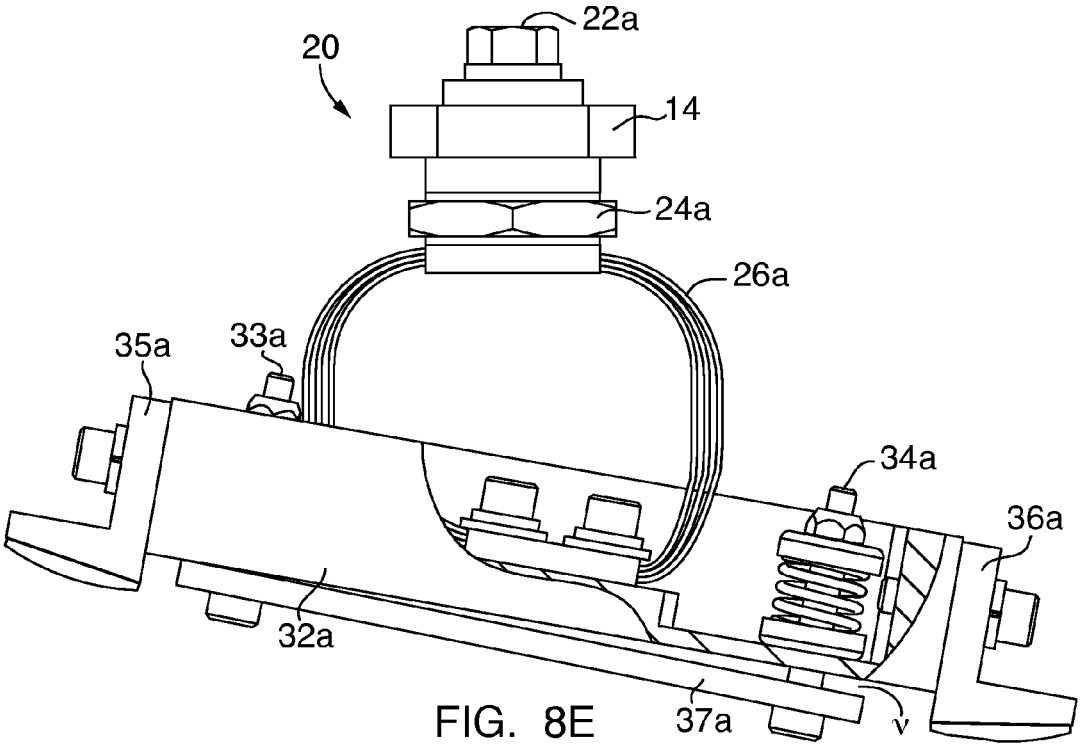
Figure 8F:
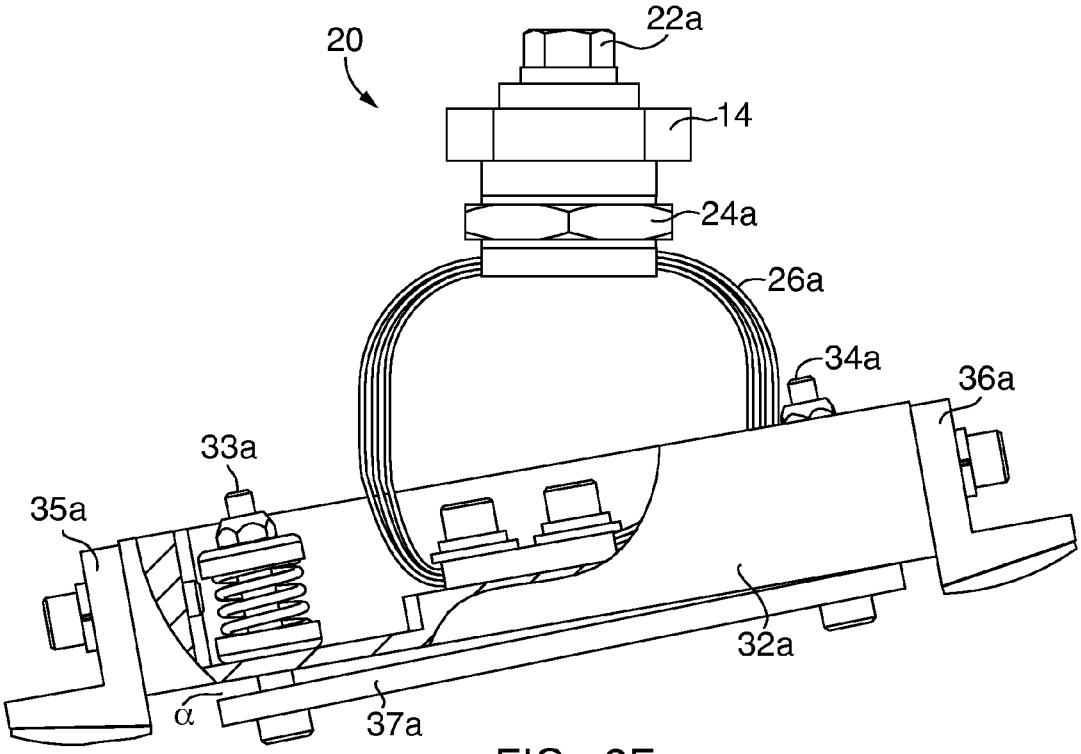

Referring to FIGS. 8E and 8F, side views of the transfer element 32*a* with respect to the platform 37*a* corresponding to the positions of the transfer assembly 30 depicted in FIGS. 8C and 8D are shown. As is shown in FIG. 8E, the overtravel angle ν is formed as the transfer element 32*a* is lifted from the platform 37*a* when the transfer element 32*a* is aligned to receive power from the normal side 40. As is shown in FIG. 8F, the overtravel angle α is formed as the transfer element 32*a* is lifted from the platform 37*a* when the transfer element 32*a* is aligned to receive power from the alternate side 40.

Figure 8G:
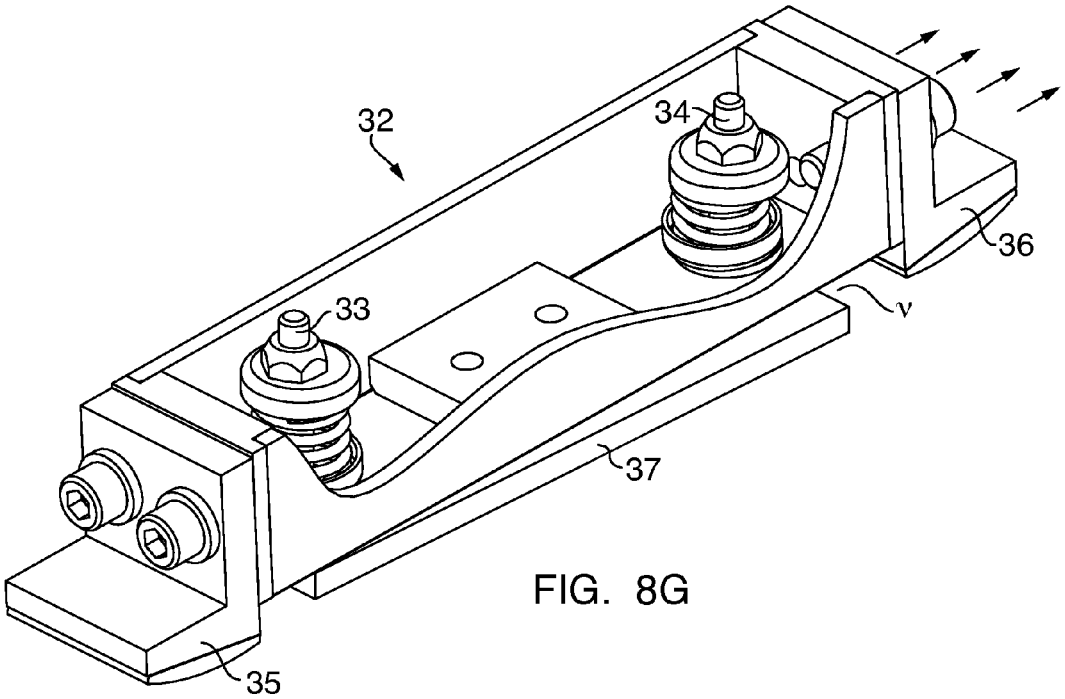
Figure 8H:
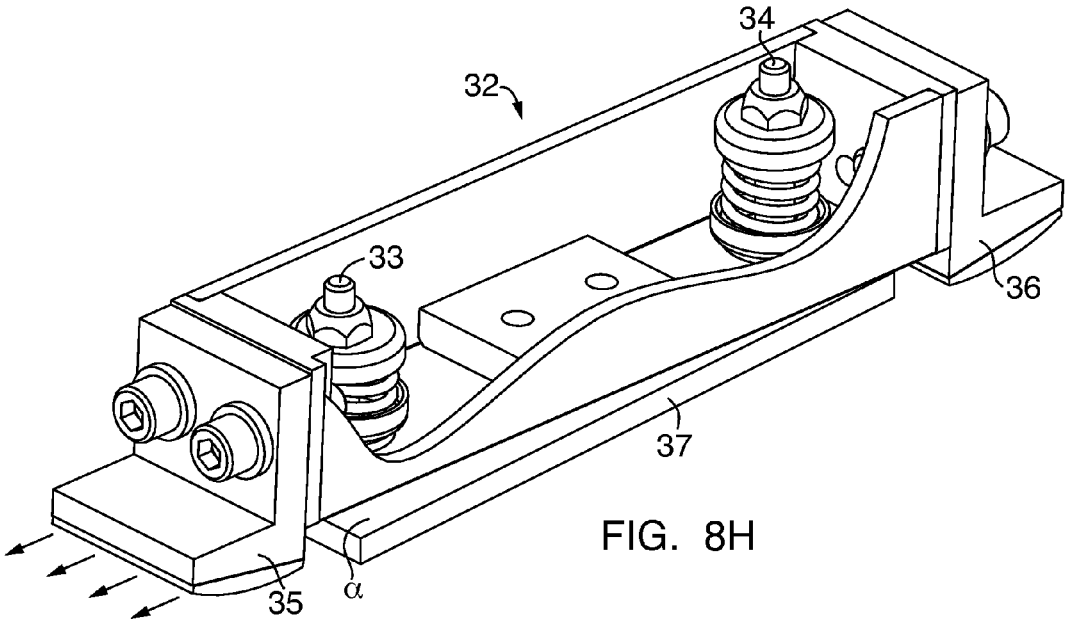

Referring to FIGS. 8G and 8H, perspective views of the transfer element 32*a* with respect to the platform 37*a* corresponding to the positions of the transfer assembly 30 depicted in FIGS. 8C and 8D are shown. Referring to FIG. 8G, an internal perspective view of the transfer element 32*a* shows the compression in the spring connector 34*a* and the overtravel angle ν between the transfer element 32*a* and the platform 37*a*. Referring to FIG. 8H, an internal perspective view of the transfer element 32*a* shows the compression in the spring connector 33*a* and the overtravel angle α between the transfer element 32*a* and the platform 37*a*.

FIGS. 8G and 8H also show the shearing action that is observed when the transfer elements 32*a* are forced into an overtravel condition. As is discussed above, where the shaft 38 continues to rotate the platforms 37*a*, 37*b*, 37*c*, thereby forcing the normal transfer contacts 36*a*, 36*b*, 36*c* to slide across the corresponding normal source contacts 46*a*, 46*b*, 46*c*, or the alternate transfer contacts 35*a*, 35*b*, 35*c* to slide across the corresponding alternate source contacts 56*a*, 56*b*, 56*c* in a manner that creates friction between the respective contacts, thereby cleansing or refining the surfaces of each of the contacts with every actuation of the transfer switch 10. Although FIGS. 8G and 8H each include arrows showing the radially outward shearing motion of the normal transfer contacts 36*a*, 36*b*, 36*c* and the alternate transfer contacts 35*a*, 35*b*, 35*c* upon the corresponding source contacts as the transfer switch 10 is placed in the normal position or the alternate position, respectively, those of ordinary skill in the art will recognize that a reciprocal radially inward shearing motion is observed as the normal transfer contacts 36*a*, 36*b*, 36*c* or the alternate transfer contacts 35*a*, 35*b*, 35*c* lift from the corresponding source contacts, as well.

Figure 9A:
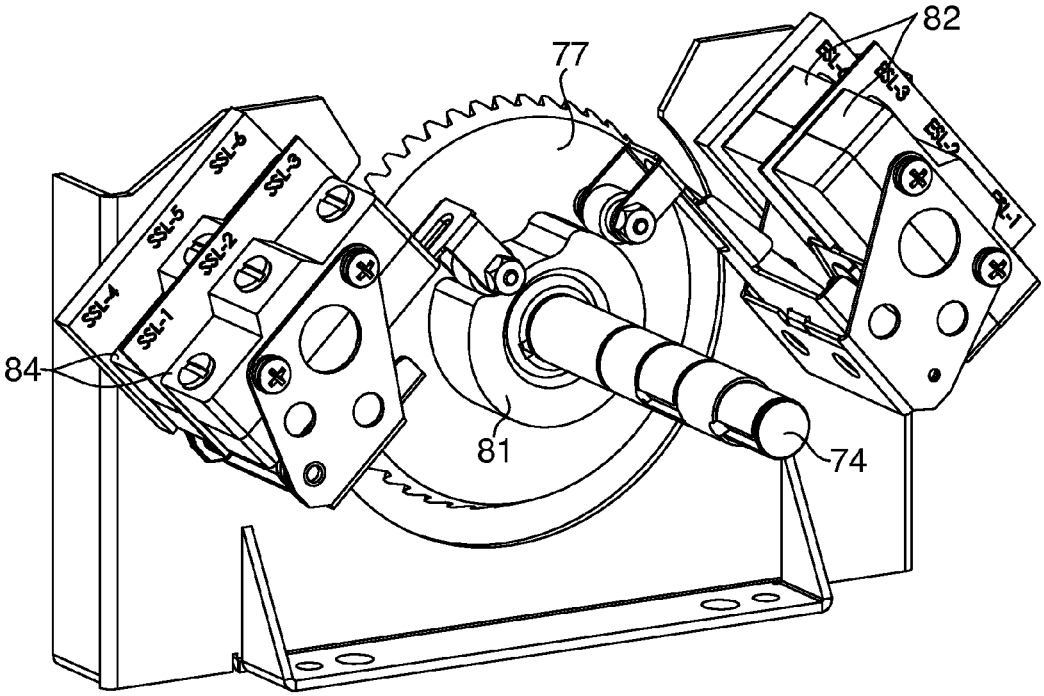
FIGS. 9A and 9B are views of a position indicator assembly, according to embodiments of the present disclosure.
Figure 9B:
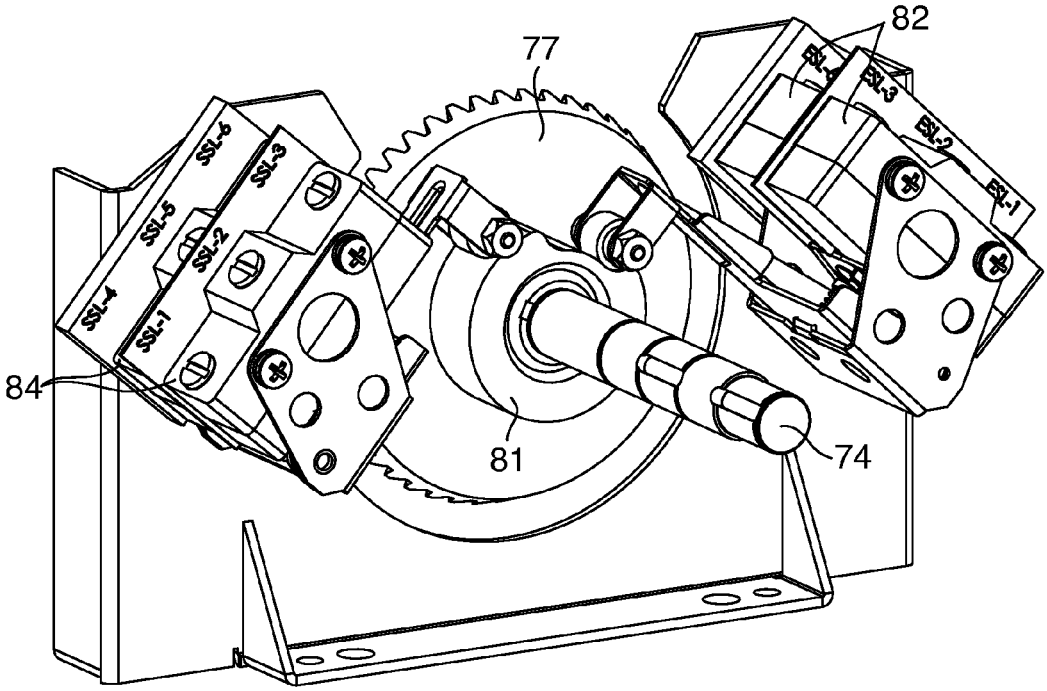

Referring to FIGS. 9A and 9B, perspective views of the position indicator assembly 80 shown in FIGS. 1-6 are shown. FIG. 9A corresponds to an alignment of the transfer switch 10 to receive power from the normal side 40, while FIG. 9B corresponds to an alignment of the transfer switch 10 to receive power from the alternate side 50.

The position indicator assembly 80 shown in FIGS. 9A and 9B includes an indicator cam 81 having a detent that is mounted to the proximal end of the idler shaft 74, limit switches 82, limit switches 84 and a frame 86. As is shown in FIG. 9A, the limit switches 84 are activated when the idler shaft 74 is in a position corresponding to the transfer element 32 being in electrical contact with the normal side 40, thereby causing the detent in the indicator cam 81 to be positioned at the limit switches 84, and the limit switches 82 are activated when the idler shaft 74 is in a position corresponding to the transfer element 32 being in electrical contact with the alternate side 50, thereby causing the detent in the indicator cam 81 to be positioned at the limit switches 82. Due to the meshed relationship between the idler gear 76 mounted to the idler shaft 74 and the inertial gear 78 mounted to the shaft 38, as is shown in FIGS. 7A and 7B, monitoring a position of the idler shaft 74 provides an electrical indication of the power source (i.e., the normal side 40 or the alternate side 50) that is aligned to provide power to the load assembly 20.

Although the position indicator assembly 80 shown in FIGS. 1-6, 9A and 9B includes a pair of limit switches 82, 84 riding about an indicator cam 81 fixed to the idler shaft 74, any system or method for determining the position of the idler shaft 74 or the shaft 84, or the applicable power source that is aligned to provide power to the load assembly 20, may be utilized in accordance with the systems and methods of the present disclosure. Moreover, one or more components of the automatic operator assembly 60, the transfer operator assembly 70 may include physical or mechanical extensions or other discernable components that provide an indicator as to the alignment of the transfer assembly 30 to either the normal side 40 or the alternate side 50, as necessary. For example, the idler shaft 74 may include an indicator operating based on an additional cam, and the indicator may provide a manually perceptible indication of a position of the transfer assembly 30 and, therefore, an orientation of the transfer switch 10. Such an indicator may be particularly helpful in low-visibility environments (e.g., dark or smoky conditions), such as those encountered by shipboard electrical systems operating at sea.

The transfer switches 10 of the present disclosure are typically mounted to or surrounded by enclosures made of sheet metal or other like material, and are typically connected to power connections that may comprise rigid, bus bars and other conductive elements having appropriate sizes and dimensions to accommodate the voltage and current required in order to power the loads that are mounted to the load assembly 20 from either the normal side 40 or the alternate side 50. Moreover, in a three-phase AC application, the transfer switch 10 shown in FIGS. 1-6 must be connected to a total of nine conductors—three at the load assembly 20, three at the normal side 40 and three at the alternate side 50—which must enter such an enclosure and be firmly mounted in electrical isolation to the respective contacts of the load assembly 20, the normal side 40 or the alternate side 50.

For example, referring again to the transfer switch 10 shown in FIGS. 1-6, the three conductors (not shown) which electrically connect the loads to the load assembly 20 must be mounted at load contacts 22*a*, 22*b*, 22*c*, preferably above the load platform 14. Likewise, the three conductors (not shown) which electrically connect the normal power source to the normal side 40 must be mounted at normal power leads 42*a*, 42*b*, 42*c*, and the three conductors (not shown) which electrically connect the alternate power source to the alternate side 50 must be mounted at alternate power leads 52*a*, 52*b*, 52*c*. Preferably, the conductors from one of the power sources (i.e., the normal power source or the alternate power source) are connected to one of the sets of power leads (i.e., those of the normal side or the alternate side) above the source platform 16, and the conductors from the other power source are connected to the other set of power leads above the source platform 16.

For simplicity, the conductors for the electrically connecting with the load assembly 20, the normal side 40 and the alternate side 50 typically enter an enclosure housing the transfer switch 10 at a single face, i.e., above or below the transfer switch 10. Due to the rugged environments in which the transfer switches 10 may be applied, however, as well as the high-voltage or high-power loads to which they may be connected, the conductors that are fastened to the normal side 40 and the alternate side 50 must be sufficiently durable and large, as well as mountable to the base platform 16 and/or any other rigid aspect of the transfer switch 10. In a preferred embodiment, for example, each conductor is a 400 MCM (or thousand circular mills) cable having approximately 40 strands and a cross-sectional area of approximately 200 square millimeters ($mm^2$), having a weight of over one pound per linear foot of cable. As a result, such an enclosure may be overcome with large, thick cables or rigid bus bars, complicating maintenance and installation of the transfer switch 10 within the enclosure.

Figure 10A:
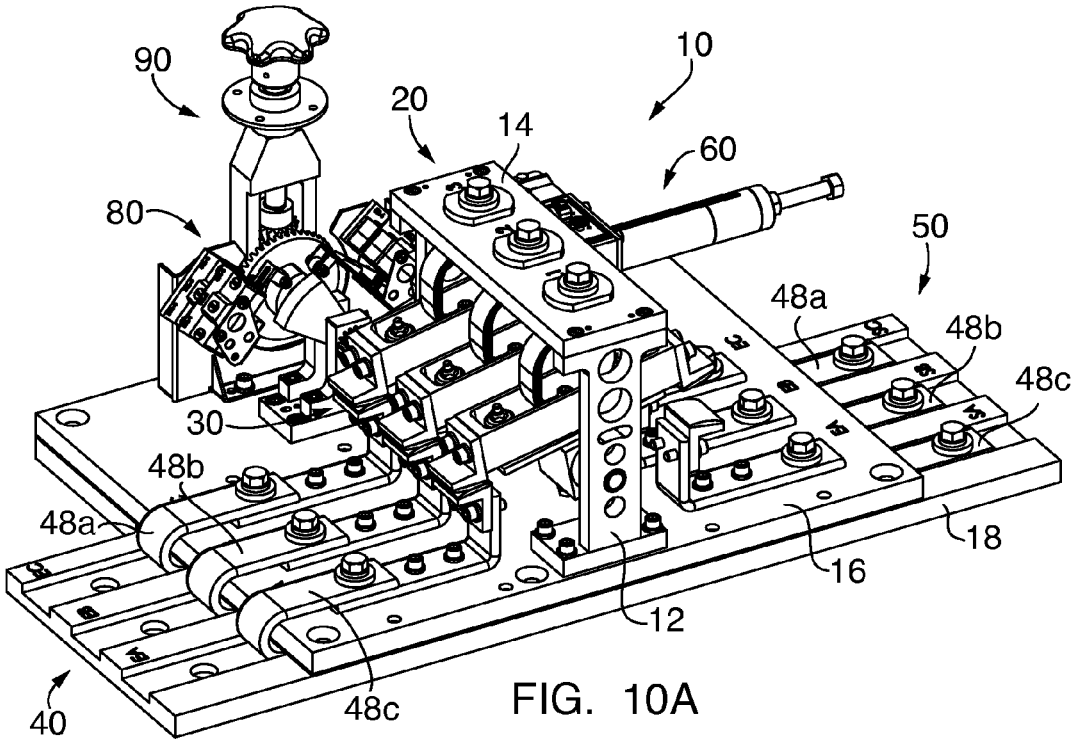
FIG. 10A is a front perspective view of an automatic transfer switch and components thereof, according to embodiments of the present disclosure.
Figure 10B:
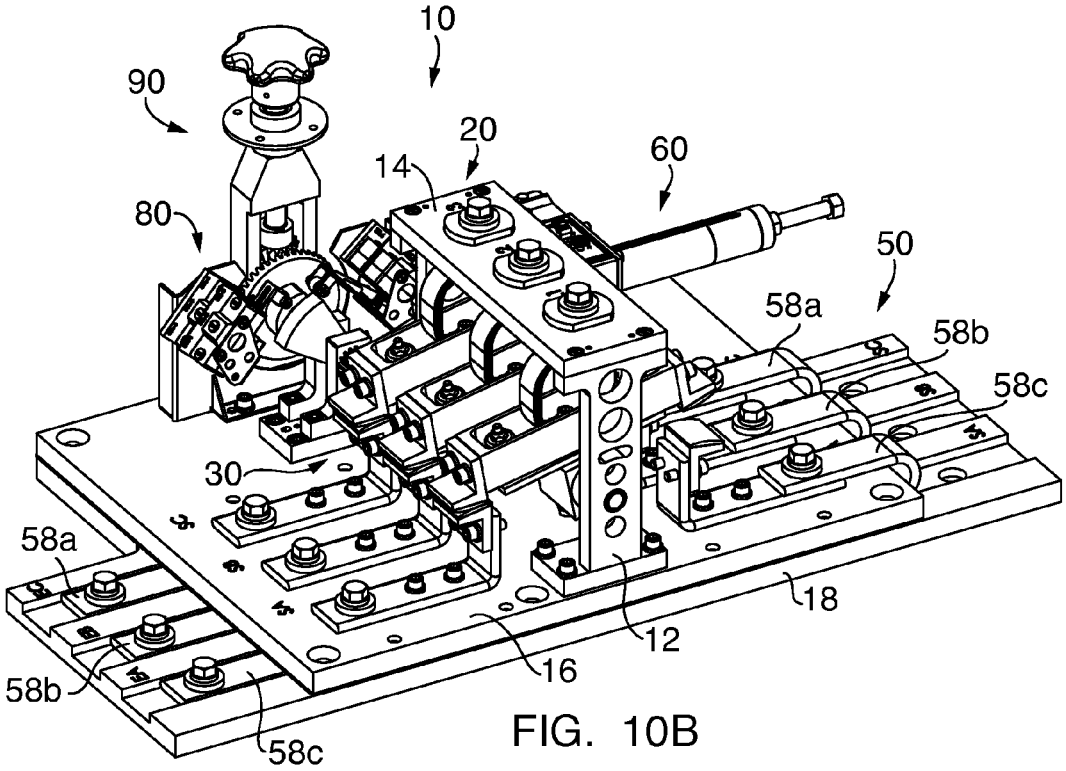
FIG. 10B is a rear perspective view of the automatic transfer switch and components thereof shown in FIG. 10A.

Referring to FIGS. 10A and 10B, one embodiment of a transfer switch 10 is shown. FIGS. 10A and 10B correspond to an alignment of the transfer switch 10 to receive power from the normal side 40. The transfer switch 10 of FIGS. 10A and 10B is similar to the transfer switch 10 shown in FIGS. 1-6, and further includes a base platform 18 mounted beneath the source platform 16. The transfer switch 10 of FIGS. 10A and 10B further includes U-shaped wrap-around normal source connectors 48*a*, 48*b*, 48*c* and alternate source connectors 58*a*, 58*b*, 58*c*, which are electrically and physically connected to the normal side leads 42*a*, 42*b*, 42*c* and alternate side leads 52*a*, 52*b*, 52*c*, respectively, by normal power fasteners 44*a*, 44*b*, 44*c* and alternate power fasteners 54*a*, 54*b*, 54*c*, and which wrap around to an end of the transfer switch 10 in a vicinity of the alternate side 50 or the normal side 40, respectively. The U-shaped wrap-around normal source connectors 48*a*, 48*b*, 48*c* and alternate source connectors 58*a*, 58*b*, 58*c*, respectively, may be positioned to facilitate cable access to the load assembly 20, the normal side 40 and the alternate side 50 from a common region of an enclosure in which the transfer switch 10 may be mounted.

For example, as is shown in FIGS. 10A and 10B, the normal source connectors 48*a*, 48*b*, 48*c* and alternate source connectors 58*a*, 58*b*, 58*c* provide electrical conductive paths that extends from the normal side 40 or the alternate side 50, around and beneath the source platform 16, between the source platform 16 and the base platform 18, to the vicinity of the alternate side 50 or the normal side 40, respectively. The normal source connectors 48*a*, 48*b*, 48*c* and the alternate source connectors 58*a*, 58*b*, 58*c* pass between the source platform 16 and the base platform 18 from a first side of an axis defined by the shaft 38 to a second side of the axis, and are electrically isolated from the other components of the transfer switch 10. In such a manner, and as is shown in FIGS. 10A and 10B, the bus bars or cables that provide power from the normal power source (not shown) to the normal side and from the alternate power source (not shown) to the alternate side 50 may be installed in a common region of an enclosure housing the transfer switch 10. Moreover, by providing the U-shaped wrap-around normal source connectors 48*a*, 48*b*, 48*c* and alternate source connectors 58*a*, 58*b*, 58*c*, respectively, the orientation of the connections to the normal side 40 or the alternate side 50, respectively, may be configured without requiring any additional parts or components to facilitate the connection of bus bars or cables to the load assembly 20, the normal side or the alternate side 50.

Furthermore, like the normal power leads 42*a*, 42*b*, 42*c* or the alternate power leads 52*a*, 52*b*, 52*c*, the normal source connectors 48*a*, 48*b*, 48*c* and the alternate source connectors 58*a*, 58*b*, 58*c* shown in FIGS. 10A and 10B may be formed from any substantially rigid conductor, such as bars or rods formed from alloys including aluminum or copper (e.g., brass). Finally, like the load platform 14 or the source platform 16, the base platform 18 may be foamed from any suitable material, such as one or more insulating or composite plastic materials of sufficient strength and durability to provide structural support to the various components of the transfer switch 10.

Figure 11A:
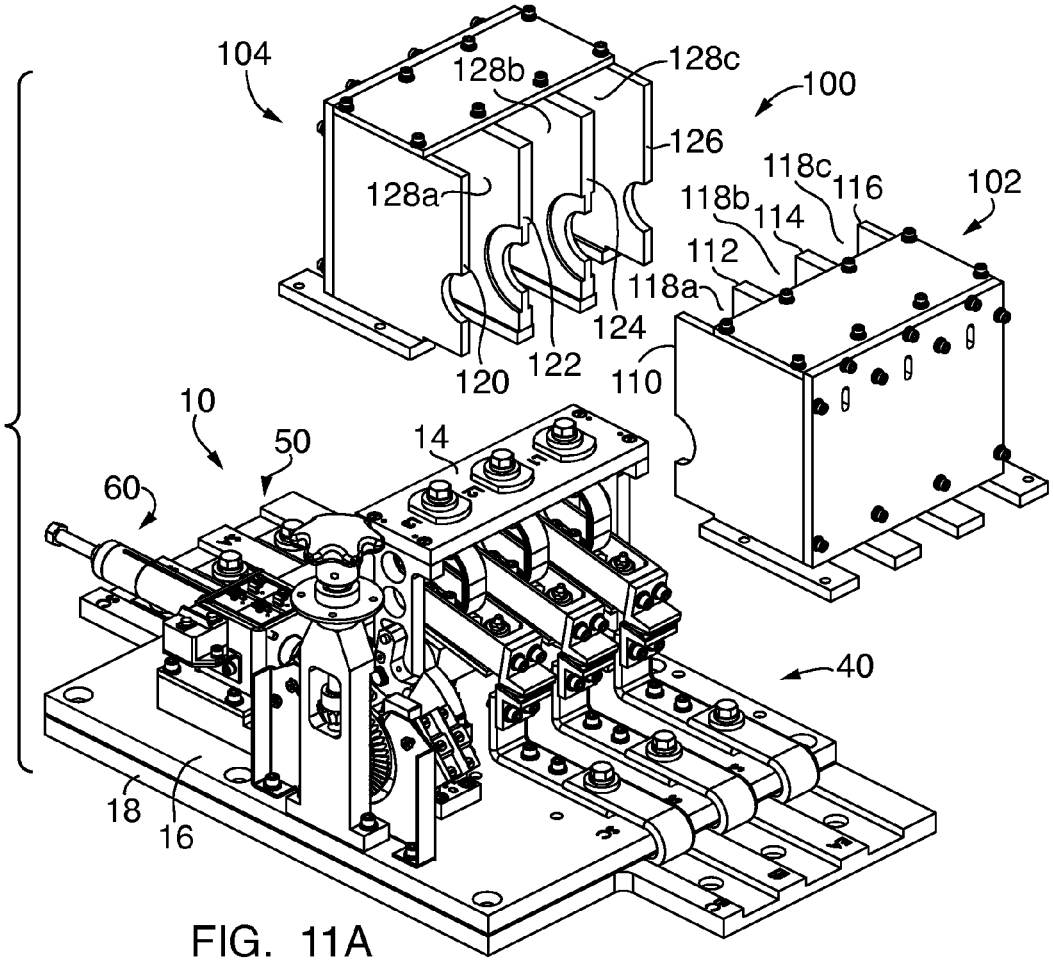
FIG. 11A is a perspective view of an automatic transfer switch and components thereof, including an exploded view of components of covers, according to embodiments of the present disclosure.
Figure 11B:
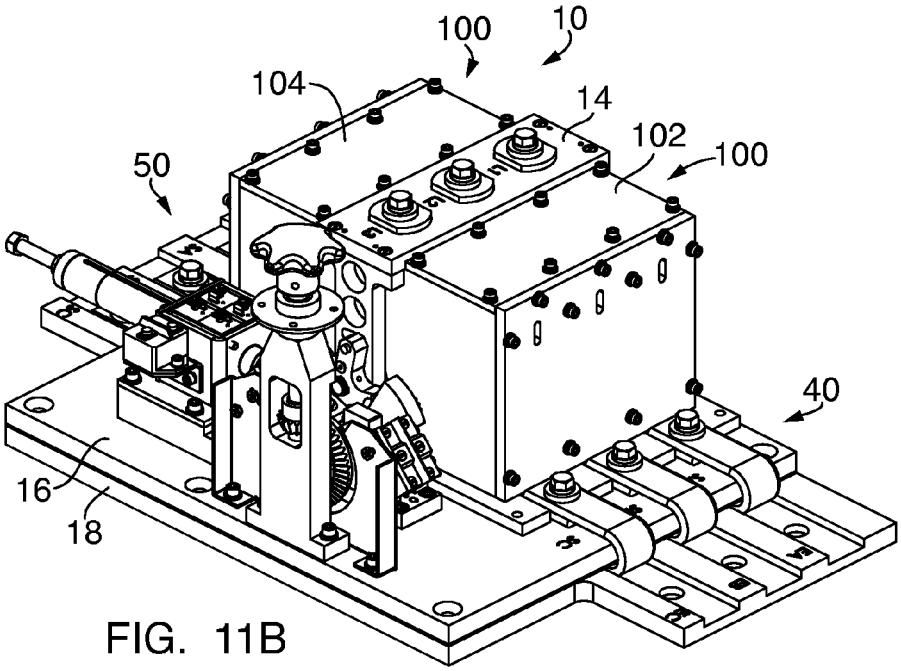
FIG. 11B is a front perspective view of the automatic transfer switch and components thereof shown in FIG. 11A, with the covers mounted thereon.

The transfer switches of the present disclosure, such as the transfer switch 10 shown in FIGS. 1-6, may be equipped with a cover or other feature to protect the components of the transfer switch 10 from any environmental effects in a vicinity in which the transfer switch 10 is installed, as well as to contain any arcing, sparking or other occurrences which may result from normal operation. Referring to FIGS. 11A-11D, a transfer switch 10 and a contact hood assembly 100, and components thereof, are shown. The transfer switch 10 shown in FIGS. 11A and 11B is similar to the transfer switch 10 shown in FIG. 1-6, 10A or 10B.

Referring to FIG. 11A, an exploded view of the contact hood assembly 100 is shown. The contact hood assembly 100 includes two covers 102, 104, and defines an opening 130. The cover 102 is shown as including insulating barriers 110, 112, 114, 116 which define three discrete chambers 118*a*, 118*b*, 118*c*. The cover 104 is shown as including insulating barriers 120, 122, 124, 126 which define three discrete chambers 128*a*, 128*b*, 128*c*. As is shown in FIG. 11A, the chambers 118*a*, 118*b*, 118*c* of the cover 102 and the chambers 128*a*, 128*b*, 128*c* of the cover 104 are symmetrically oriented and sized to accommodate the transfer elements 32*a*, 32*b*, 32*c* within the contact hood assembly 100 when the contact hood assembly 100 is installed on the transfer switch 10, and to permit the transfer switch 10 to operate in a full range of positions during operation while isolating the respective transfer elements 32*a*, 32*b*, 32*c* from one another. Additionally, the opening 130 is defined as extending along a length of the contact hood assembly 100 when the covers 102, 104 are mounted to the transfer switch 10, and is also sized to accommodate the shaft 38 in a full range of positions during operation.

One or more exterior faces of the covers 102, 104 may include one or more openings or other ventilation holes for venting gases that may be trapped within the contact hood assembly 100 in the event of any arcing, sparking or minor explosions, and one or more interior surfaces of the covers 102, 104 may include arc baffling extensions of other features for suppressing any arcs that may develop during operation of the transfer switch 10. Moreover, the covers 102, 104 may further include one or more apertures, openings or other features for releasably mounting the covers 102, 104 to one or more elements of the transfer switch 10.

Referring to FIG. 11B, the transfer switch 10 and the contact hood assembly 100 of FIG. 11A are shown, with the contact hood assembly 100 mounted to the transfer switch 10. As is shown in FIG. 11B, the contact hood assembly 100 conceals the contacting portions of the transfer switch 10 (i.e., the leads from the normal side 40 and the alternate side 50 which contact the respective transfer elements 32*a*, 32*b*, 32*c* during operation while leaving the contacts for the load assembly 20 and much of the automatic operator assembly 60, the transfer operator assembly 70, the position indicator assembly 80 and the manual operator assembly 90 open and accessible for maintenance or other operations. In this regard, by mounting the contact hood assembly 100 to the transfer switch 10, as is shown in FIG. 11B, the contacting portions of the transfer switch 10 may be protected from environmental hazards while also containing any arcing, sparking or other adverse effects that may occur as the loads of the load assembly 20 are transferred from the normal side 40 to the alternate side 50, or vice versa, during normal operation.

Figure 11C:
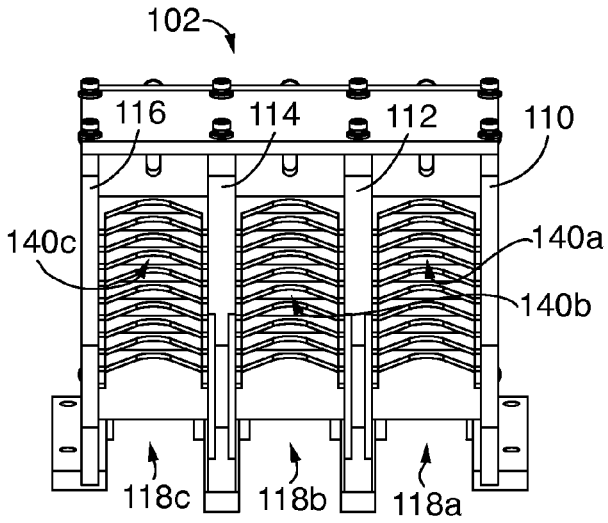
FIGS. 11C and 11D are views of the covers of FIG. 11A, according to embodiments of the present disclosure.
Figure 11D:
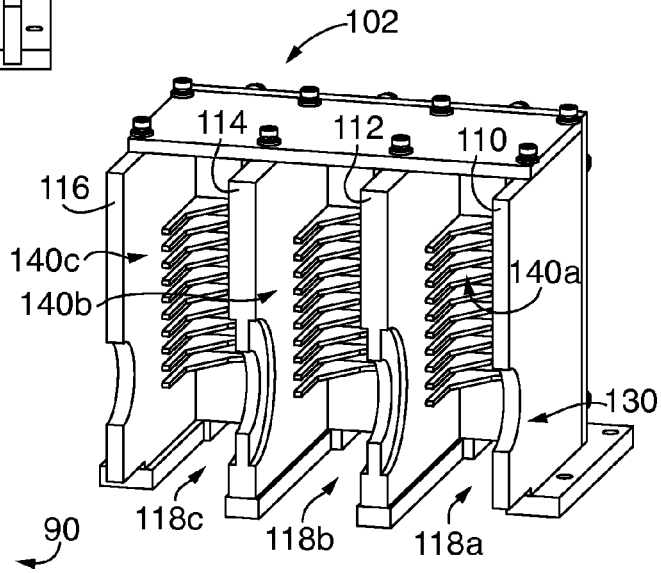

Referring to FIGS. 11C and 11D, interior and perspective views of the cover 102 of the contact hood assembly 100 depicted in FIGS. 11A and 11B are shown. Within the chambers 118*a*, 118*b*, 118*c* of the cover 102 are shown respective pluralities of baffles 140*a*, 140*b*, 140*c*. Such baffles may be formed of aluminum, steel or any other suitable material, and are intended to suppress or extinguish any extreme arcing or sparking that may occur within each chamber during operation, i.e., around each of the respective contacts.

Figure 12A:
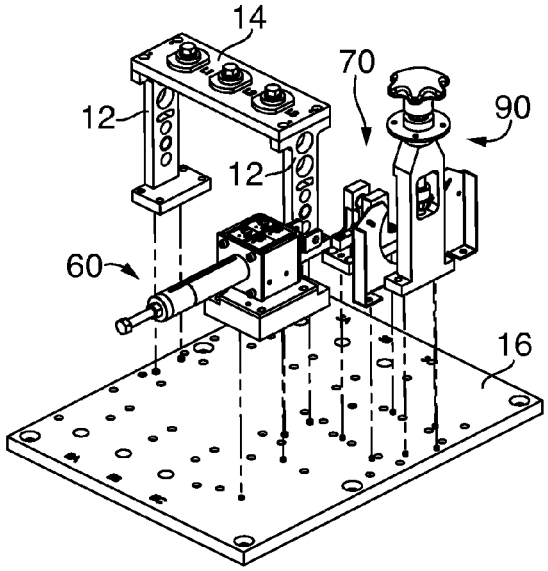
FIG. 12A is a view of components of one embodiment of an automated transfer switch in various stages of assembly, according to embodiments of the present disclosure.

The components of the transfer switches disclosed herein may be assembled singularly or collectively, or in a modular manner. Referring to FIG. 12A, the precise location of some of the components of the transfer switch 10 of FIGS. 1-6 are shown. As is shown in FIG. 12A, the solenoid assembly 60, the transfer operator assembly 70, the manual operator assembly 90 are shown as being mounted to the frame 12, the load platform 14 and the source platform 16, to ensure their mass-centered orientation with respect to an axis. The components of the transfer switch 10 shown in FIG. 12A may be fixed to the source platform 16 using one or more precision pins and, once fixed in place on the source platform, the components may be connected to other components not shown in FIG. 12A, such as the components of the load assembly 20, the transfer assembly 30, the normal side 40 and the alternate side 50.

Figure 12B:
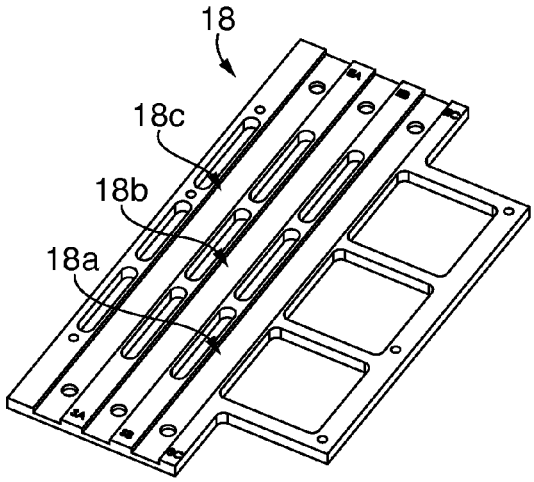
FIG. 12B is a view of a base platform of an automated transfer switch, according to embodiments of the present disclosure.

Moreover, as is discussed above, the transfer switches of the present disclosure may be mounted to a base platform adapted to receive one or more wrap-around source connectors. Referring to FIG. 12B, a base platform 18 is shown. The base platform 18 features channels 18*a*, 18*b*, 18*c*, each of which is sized and adapted to accommodate a wrap-around connector, such as the normal source connectors 48*a*, 48*b*, 48*c* of FIG. 10A or the alternate source connectors 58*a*, 58*b*, 58*c* of FIG. 12B. The base platform 18 shown in FIG. 12B acts as an insulated frame for supporting the source platform 16 and other components of the transfer switch 10, and may be mounted to the source platform 16, before, after or in connection with the mounting of the various components of the transfer switch 10, such as the components shown in FIG. 12A.

Although the disclosure has been described herein using exemplary techniques, components, and/or processes for implementing the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. While the present disclosure describes exemplary embodiments that may be associated with three-phase alternating current (AC) power supplies and loads, the systems and methods of the present disclosure are not so limited, and may be utilized in connection with any computer-based electronic communication systems or methods.

For example, the systems and methods of the present disclosure may be utilized to align single-phase AC power loads with normal and alternate power supplies. According to one embodiment, a transfer switch including a single transfer element, such as one of the transfer elements 32*a*, 32*b*, 32*c* shown in FIGS. 8A-8D, could be used to transfer one or more single-phase AC loads from a normal side having a single-phase AC power source to an alternate side having a single-phase AC power source, or vice versa, according to the systems and methods disclosed herein. Those of ordinary skill in the art would also recognize that the transfer switches of the present disclosure may be utilized in direct current (DC) applications. Moreover, those of ordinary skill in the art would also recognize that the transfer switches disclosed herein could also be utilized to return the one or more loads from the alternate power source to the normal power source, once power is restored to the normal source.

The systems and methods of the present disclosure may be utilized to transfer power at any voltage level or frequency from one power source to another. For example, in AC applications, the transfer switches disclosed herein may preferably transfer AC power at approximately 120, 208, or 450 volts (V), and at any frequency such as 60 or 400 Hertz (Hz), or at any other voltage or frequency levels. In DC applications, the transfer switches disclosed herein may preferably transfer power at 240 volts (V), or any other voltage level.

Furthermore, the systems and methods disclosed herein are also not limited to binary situations in which only two power supplies are provided. For example, one embodiment of the present disclosure may include a shaft having transfer elements mounted thereon, wherein the shaft is adapted to rotate between three positions corresponding to first, second and third power sources, in response to a casualty and/or the status of available power at the respective power sources. The systems and methods of the present disclosure may also be adapted to open all of the connections with available power sources (i.e., to rotate the shaft 38 shown in FIGS. 8A-8D to a third, intermediate position in which the transfer elements 32*a*, 32*b*, 32*c* do not contact either the normal source contacts 46*a*, 46*b*, 46*c* or the alternate source contacts 56*a*, 56*b*, 56*c*), thereby placing the transfer switch in an open position, in the event of a casualty or other failure experienced by both power sources.

It should be understood that, unless otherwise explicitly or implicitly indicated herein, any of the features, characteristics, alternatives or modifications described regarding a particular embodiment herein may also be applied, used, or incorporated with any other embodiment described herein. Moreover, with respect to the one or more methods or processes of the present disclosure described herein, the order in which the methods or processes are listed is not intended to be construed as a limitation on the claimed inventions, and any number of the method or process steps can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey that certain embodiments could include, but do not require, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. Indeed, although the invention has been described and illustrated with respect to exemplary embodiments thereof, the foregoing and various other additions and omissions may be made therein and thereto without departing from the spirit and scope of the present disclosure.

What is claimed is:

1. An automatic bus transfer switch for providing three-phase alternating current power to a three-phase load, the switch comprising:

a normal source assembly comprising three normal source contacts, wherein each of the normal source contacts is adapted to receive alternating current power in one phase from a normal power source;

an alternate source assembly comprising three alternate source contacts, wherein each of the alternate source contacts is adapted to receive alternating current power in one phase from an alternate power source;

a rocker assembly comprising three rockers and a shaft defining an axis, wherein each of the three rockers is mounted to the shaft, wherein each of the rockers comprises a normal rocker contact and an alternate rocker contact, wherein the normal rocker contact is adapted to make contact with one of the normal source contacts, and wherein the alternate rocker contact is adapted to make contact with one of the alternate source contacts;

a solenoid-actuated automatic operator assembly mechanically connected to the shaft, the solenoid-actuated operator comprising a solenoid having at least one solenoid coil, a solenoid plunger and a mechanical linkage fixed to the solenoid plunger, the mechanical linkage providing the mechanical connection to the main shaft, wherein the automatic operator is adapted to rotate the shaft between a normal position and an alternate position, wherein each of the normal rocker contacts is in electrical contact with one of the normal source contacts when the shaft is in the normal position, and wherein each of the alternate rocker contacts is in electrical contact with one of the alternate source contacts when the shaft is in the alternate position;

a main gear mounted to a proximal end of the main shaft;

an idler shaft having an inertial cam connected to the mechanical linkage of the solenoid-actuated operator;

a first idler gear fixed to a distal end of the idler shaft, wherein the first idler gear is meshed with the main gear;

a load assembly comprising three load contacts, wherein each of the load contacts is adapted to connect with one phase of the three-phase load; and three flexible conductors, wherein each of the flexible conductors provides an electrical connection between one of the rockers and one of the load contacts.

2. The automatic bus transfer switch of claim 1, wherein each of the flexible conductors comprises a braided copper loop providing two conductive paths between one of the rockers and one of the load contacts.

3. The automatic bus transfer switch of claim 1, wherein each of the rockers is mounted to the shaft in a spring-mounted connection, wherein each of the spring-mounted connections biases each of the normal rocker contacts into one of the normal source contacts when the shaft is in the normal position, and wherein each of the spring-mounted connections biases each of the alternate rocker contacts into one of the alternate source contacts when the shaft is in the alternate position.

4. The automatic bus transfer switch of claim 1, wherein the rocker assembly is mass-centered about the axis.

5. A transfer switch comprising:

at least one first source contact;

at least one second source contact;

at least one load contact;

a main shaft defining an axis, wherein the main shaft is adapted to rotate between a first angular position and a second angular position;

at least one rotatable transfer element fixed to the main shaft, wherein the transfer element is adapted to rotate between a first contact position in which the main shaft is in the first angular position and a second contact position in which the main shaft is in the second angular position;

a load platform providing support for the at least one load contact;

a frame providing support for the main shaft and the load platform;

a source platform providing support for the at least one first source contact, the at least one second source contact and the frame on a top side of the source platform;

a base platform mounted to a bottom side of the source platform;

a U-shaped source connector mounted to the at least one first source contact;

a solenoid-actuated operator mechanically connected at least one rotatable transfer element, wherein the solenoid-actuated operator is adapted to cause the at least one rotatable transfer element to rotate between the first contact position and the second contact position; and at least one flexible conductor, wherein the at least one flexible conductor provides an electrical connection between the at least one transfer element and the at least one load contact;

wherein the at least one first source contact is mounted to the source platform on a first side of the axis and the at least one second source contact is mounted to the source platform on a second side of the axis;

wherein the U-shaped source connector is electrically connected to the at least one first source contact on the top side of the source platform and extends between the base platform and the source platform from the first side of the axis to the second side of the axis;

wherein the at least one transfer element is in electrical contact with the at least one first source element when the at least one rotatable transfer element is in the first contact position, and wherein the at least one transfer element is in electrical contact with the at least one second source element when the at least one rotatable transfer element is in the second contact position.

6. The transfer switch of claim 5, wherein the transfer switch is substantially mass-centered about a centerline defined by the axis.

7. The transfer switch of claim 6, further comprising a transfer operator assembly adapted to rotate the main shaft, wherein the solenoid-actuated operator comprises a solenoid having at least one solenoid coil, a solenoid plunger and a mechanical linkage fixed to the solenoid plunger, and wherein the mechanical linkage provides the mechanical connection to the main shaft.

8. The transfer switch of claim 7, wherein the solenoid comprises an adjustable spring providing tension to the solenoid plunger.

9. The transfer switch of claim 6, wherein the at least one flexible conductor is formed in at least one continuous loop having a first connection to the transfer element and a second connection to the load contact.

10. The transfer switch of claim 9, wherein the at least one continuous loop is substantially mass-centered about the centerline.

11. The transfer switch of claim 9, wherein the at least one continuous loop is a compressed mesh tubing.

12. The transfer switch of claim 6, wherein the at least one transfer element comprises a trench having a base, a first end and a second end.

13. The transfer switch of claim 12, wherein the at least one transfer element comprises a first transfer contact mounted to the first end and a second transfer contact mounted to the second end, wherein the first transfer contact is adapted to contact the at least one first source contact when the shaft is in the first angular position, and wherein the second transfer contact is adapted to contact the at least one second source contact when the shaft is in the second angular position.

14. The transfer switch of claim 12, further comprising at least a first spring and a second spring for fixing the base of the at least one transfer element to the main shaft, and wherein the first spring is configured to bias the at least one transfer element into contact with the at least one first source contact when the main shaft is in the first angular position, and wherein the second spring is configured to bias the at least one transfer element into contact with the at least one second source contact when the main shaft is in the second angular position.

15. The transfer switch of claim 5, wherein the transfer switch is adapted to transfer three-phase electrical power from one of a first power source and a second power source to at least one load.

16. The transfer switch of claim 5, wherein the transfer switch comprises three transfer elements, three first source contacts, three second source contacts, three load contacts and three flexible conductors, wherein each of the three transfer elements is fixed to the main shaft, wherein each of the three flexible conductors provides electrical connections between one of the transfer elements and one of the load contacts, wherein each of the transfer elements is in electrical contact with one of the first source elements when the main shaft is in the first angular position, and wherein each of the transfer elements is in electrical contact with one of the second source elements when the main shaft is in the second angular position.

17. A transfer switch comprising:

at least one first source contact;

at least one second source contact;

at least one load contact;

a main shaft defining an axis, wherein the main shaft is adapted to rotate between a first angular position and a second angular position;

at least one rotatable transfer element fixed to the main shaft, wherein the transfer element is adapted to rotate between a first contact position in which the main shaft is in the first angular position and a second contact position in which the main shaft is in the second angular position;

a solenoid-actuated operator mechanically connected to at least one rotatable transfer element, wherein the solenoid-actuated operator is adapted to rotate the main shaft to cause the at least one rotatable transfer element to rotate between the first contact position and the second contact position, the solenoid-actuated operator comprising a solenoid having at least one solenoid coil, a solenoid plunger and a mechanical linkage fixed to the solenoid plunger, the mechanical linkage providing the mechanical connection to the main shaft;

at least one flexible conductor, wherein the at least one flexible conductor provides an electrical connection between the at least one transfer element and the at least one load contact;

a main gear mounted to a proximal end of the main shaft;

an idler shaft having an inertial cam connected to the mechanical linkage of the solenoid-actuated operator; and a first idler gear fixed to a distal end of the idler shaft;

wherein the first idler gear is meshed with the main gear;

wherein the transfer switch is substantially mass-centered about a centerline defined by the axis;

wherein the at least one transfer element is in electrical contact with the at least one first source element when the at least one rotatable transfer element is in the first contact position; and wherein the at least one transfer element is in electrical contact with the at least one second source element when the at least one rotatable transfer element is in the second contact position.

18. The transfer switch of claim 17, further comprising:

a manual operator mechanically connected to a second idler gear fixed to a proximal end of the idler shaft.

19. The transfer switch of claim 17, wherein the at least one flexible conductor is formed in at least one continuous loop having a first connection to the transfer element and a second connection to the load contact.

20. The transfer switch of claim 19, wherein the at least one continuous loop is substantially mass-centered about the centerline.

21. The transfer switch of claim 19, wherein the at least one continuous loop is a compressed mesh tubing.

* * * * *